US011737503B2

(12) United States Patent
Pezzimenti et al.

(10) Patent No.: US 11,737,503 B2
(45) Date of Patent: Aug. 29, 2023

(54) INSULATED GARMENT

(71) Applicant: NIKE, Inc., Beaverton, OR (US)

(72) Inventors: Luke A. Pezzimenti, Portland, OR (US); Jacob R. Arnold, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 61 days.

(21) Appl. No.: 17/208,548

(22) Filed: Mar. 22, 2021

(65) Prior Publication Data

US 2021/0204626 A1 Jul. 8, 2021

Related U.S. Application Data

(62) Division of application No. 15/724,702, filed on Oct. 4, 2017, now Pat. No. 11,019,865.
(Continued)

(51) Int. Cl.

| | |
|---|---|
| ***A41D 27/00*** | (2006.01) |
| ***A41D 31/06*** | (2019.01) |
| ***A41D 27/24*** | (2006.01) |
| ***A41D 27/28*** | (2006.01) |
| ***A41D 27/02*** | (2006.01) |

(52) U.S. Cl.
CPC ..... *A41D 31/065* (2019.02); *A41D 27/02* (2013.01); *A41D 27/24* (2013.01); *A41D 27/28* (2013.01); *A41D 2300/50* (2013.01); *A41D 2300/52* (2013.01); *A41D 2400/10* (2013.01); *A41D 2500/10* (2013.01); *A41D 2500/20* (2013.01); *A41D 2500/30* (2013.01)

(58) Field of Classification Search
CPC ..... A41D 2300/50; A41D 2500/10; A41D 27/00; A41D 27/20
See application file for complete search history.

(56) References Cited

U.S. PATENT DOCUMENTS

| | | | |
|---|---|---|---|
| 317,711 | A | 5/1885 | Brinkmann |
| 385,306 | A | 6/1888 | Helwitz |

(Continued)

FOREIGN PATENT DOCUMENTS

| | | | |
|---|---|---|---|
| CN | 2337793 | Y | 9/1999 |
| CN | 1864574 | A | 11/2006 |

(Continued)

OTHER PUBLICATIONS

Notice of Allowance received for Canadian Patent Application No. 3034446, dated May 18, 2021, 1 page.

(Continued)

*Primary Examiner* — Richale L Quinn
(74) *Attorney, Agent, or Firm* — SHOOK, HARDY & BACON L.L.P.

(57) ABSTRACT

The technology described herein generally relates to a garment that is insulating yet light weight, which may provide protection from the elements without weighing down the wearer. The garment in accordance with the technology described herein comprises a layer of thermally insulating sheet material having one or more voided portions in place of conventional down or other synthetic thermally insulating materials. The one or more voided portions allow the thermal insulation to be light weight and adequately protective in cooler/cold weather, without adding motion hindering bulk to the garment.

13 Claims, 19 Drawing Sheets

Related U.S. Application Data

(60) Provisional application No. 62/404,966, filed on Oct. 6, 2016.

(56) References Cited

U.S. PATENT DOCUMENTS 1,252,187 A 1/1918 Shane
1,252,188 A 1/1918 Shane
1,612,010 A * 12/1926 Gray ..... A41B 1/00 2/87
1,788,731 A 1/1931 Mishel
2,084,173 A 6/1937 Louis
2,121,836 A 6/1938 Steinberger
2,353,984 A 7/1944 Barone
2,372,632 A 3/1945 Webb
2,385,124 A 9/1945 Barone
2,464,380 A 3/1949 Daiber
2,466,911 A 4/1949 Raymond
2,540,547 A 2/1951 Rodert
2,851,390 A * 9/1958 Chavannes ..... A41D 31/102 36/3 R
3,115,564 A 12/1963 Stacy
3,405,674 A * 10/1968 Coates ..... D04H 1/02 112/420
3,482,567 A 12/1969 Franklin
3,562,041 A 2/1971 Robertson
3,706,102 A 12/1972 Grenier
3,761,962 A 10/1973 Myers
3,771,170 A * 11/1973 Leon ..... A41D 31/065 2/97
3,801,987 A 4/1974 Thompson
3,819,465 A 6/1974 Parsons et al.
3,852,144 A 12/1974 Parry
3,876,493 A 4/1975 Gilmore
4,039,709 A * 8/1977 Newman ..... B32B 5/08 428/317.1
4,048,675 A 9/1977 Griffin
4,115,610 A 9/1978 Wortman
4,181,993 A 1/1980 Mcdaniel
4,185,327 A 1/1980 Markve
4,251,312 A 2/1981 Ziegler et al.
4,311,542 A 1/1982 Mueller et al.
4,370,754 A 2/1983 Donzis
4,396,039 A 8/1983 Klenk et al.
4,471,759 A 9/1984 Anderson et al.
4,496,407 A 1/1985 Lowery et al.
4,502,153 A 3/1985 Lapedes et al.
4,547,906 A 10/1985 Nishida et al.
4,560,427 A * 12/1985 Flood ..... B29C 65/7435 156/580.2
4,583,247 A * 4/1986 Fingerhut ..... B32B 5/18 2/81
4,603,069 A 7/1986 Haq et al.
4,604,152 A 8/1986 Liukko
4,608,715 A 9/1986 Miller et al.
4,610,750 A 9/1986 Mango
4,625,336 A 12/1986 Derderian
4,693,771 A 9/1987 Payet et al.
4,713,131 A 12/1987 Obeda
4,716,598 A 1/1988 Bertram
4,737,212 A 4/1988 Emrich et al.
4,756,937 A * 7/1988 Mentzer ..... B65D 85/84 428/36.1
4,788,972 A 12/1988 Debusk
4,791,685 A 12/1988 Maibauer
4,938,817 A 7/1990 Langley
4,962,554 A 10/1990 Tesch
4,971,041 A 11/1990 Millikan et al.
5,001,783 A 3/1991 Grilliot et al.
5,003,902 A * 4/1991 Benstock ..... B29C 66/30325 112/440
5,021,280 A 6/1991 Farnworth et al.
5,048,126 A 9/1991 Mclaughlin
5,067,178 A 11/1991 Katchka
5,131,097 A * 7/1992 Grilliot ..... B32B 3/28 428/920
5,150,476 A 9/1992 Statham et al.
5,165,115 A 11/1992 Stanislaw
5,168,576 A * 12/1992 Krent ..... A41D 13/0156 2/463
5,201,075 A 4/1993 Svetich
5,255,392 A 10/1993 Stanislaw
5,267,519 A * 12/1993 Uglene ..... B32B 5/18 112/440
5,408,700 A 4/1995 Reuben et al.
5,445,863 A 8/1995 Slagle et al.
5,446,927 A * 9/1995 Weldon ..... A41D 27/28 2/243.1
5,483,713 A * 1/1996 Kikuchi ..... A41D 27/245 112/440
5,526,534 A 6/1996 Lazar
5,545,128 A 8/1996 Hayes et al.
5,665,196 A 9/1997 Combe et al.
5,692,245 A * 12/1997 Reuben ..... A41D 27/02 2/243.1
5,704,064 A 1/1998 Van
5,713,079 A * 2/1998 Simon ..... A41D 3/00 2/243.1
5,787,502 A 8/1998 Middleton
5,799,600 A * 9/1998 Reuben ..... A47G 9/0207 112/475.08
5,885,679 A 3/1999 Yasue et al.
5,924,134 A * 7/1999 Taylor ..... A41D 31/085 2/81
5,935,878 A 8/1999 Glasser
6,009,560 A 1/2000 Mckenney et al.
6,018,819 A 2/2000 King et al.
6,035,442 A 3/2000 Marando
6,038,700 A 3/2000 Aldridge et al.
6,049,908 A 4/2000 Bullock et al.
6,076,195 A 6/2000 Klein
6,076,196 A 6/2000 Masumoto
6,112,328 A 9/2000 Spector
6,182,297 B1 2/2001 Duren et al.
6,263,511 B1 7/2001 Moretti
6,279,161 B1 * 8/2001 Johnston ..... A41D 13/0015 2/69
6,332,221 B1 12/2001 Gracey
6,339,843 B1 1/2002 Grilliot et al.
6,405,375 B1 6/2002 Sardi
6,427,242 B1 8/2002 Bush et al.
6,547,327 B1 * 4/2003 Yates ..... B62J 1/20 297/214
6,557,479 B2 5/2003 Alberts et al.
6,579,403 B2 6/2003 Tolbert et al.
6,632,501 B2 * 10/2003 Brownstein ..... B01J 20/26 428/220
6,649,251 B1 11/2003 Druecke et al.
6,743,498 B2 * 6/2004 Fourmeux ..... A41D 31/08 428/920
6,805,181 B2 10/2004 Blundell et al.
6,808,791 B2 10/2004 Curro et al.
6,817,037 B1 11/2004 King
6,928,665 B1 8/2005 Yates
7,005,021 B2 2/2006 Kramer
7,017,191 B2 3/2006 Golde
7,037,569 B2 5/2006 Curro et al.
7,051,373 B1 5/2006 Krall
7,094,714 B2 8/2006 Li et al.
7,111,328 B2 9/2006 Bay
7,140,048 B2 11/2006 Wallerstein
7,147,911 B2 12/2006 Baychar
7,437,774 B2 10/2008 Baron et al.
7,578,005 B2 8/2009 Vereen
7,757,311 B2 7/2010 Garneau
7,827,624 B1 11/2010 Cole
7,926,124 B2 4/2011 Hunter et al.
8,028,386 B2 10/2011 Rock et al.
8,057,878 B2 11/2011 Lo et al.
8,070,905 B2 12/2011 Brennan
8,127,701 B2 3/2012 Harward
8,133,824 B2 3/2012 Harber

(56) References Cited

U.S. PATENT DOCUMENTS 8,377,536 B2 2/2013 Cienski
8,399,085 B2 3/2013 Moore et al.
8,458,819 B1 6/2013 Hoole
8,518,511 B2 8/2013 Harward
D693,095 S * 11/2013 Grant ..... D2/834
8,578,516 B2 * 11/2013 Li ..... A47G 9/02 5/413 R
8,756,714 B2 6/2014 Reimer
D713,620 S * 9/2014 Pezzimenti ..... D2/828
D713,621 S 9/2014 Pezzimenti et al.
D714,022 S 9/2014 Mong et al.
8,828,167 B2 * 9/2014 Hannon ..... B29C 66/72343 156/290
8,840,745 B2 * 9/2014 Green ..... D06Q 1/12 156/277
9,023,161 B2 * 5/2015 Ma ..... B29C 66/0384 156/73.4
9,138,060 B2 9/2015 Vainberg et al.
9,247,830 B2 * 2/2016 Waters ..... A47D 13/06
9,392,825 B2 7/2016 Pezzimenti et al.
9,609,901 B2 4/2017 Nordstrom et al.
9,881,093 B2 1/2018 Butler
10,111,480 B2 10/2018 Pezzimenti
10,362,820 B2 7/2019 Pezzimenti et al.
10,842,211 B2 * 11/2020 Inoue ..... A41D 31/065
2002/0016122 A1 2/2002 Curro et al.
2002/0022426 A1 2/2002 Curro et al.
2002/0034912 A1 * 3/2002 Curro ..... B29C 66/83413 428/103
2002/0034913 A1 3/2002 Curro et al.
2002/0114918 A1 8/2002 Mossbeck et al.
2002/0183671 A1 12/2002 Henderson et al.
2003/0033656 A1 2/2003 Jaeger
2003/0126673 A1 7/2003 Yardley
2003/0138586 A1 * 7/2003 Fowler ..... B29C 65/5085 428/102
2003/0208831 A1 11/2003 Lazar et al.
2004/0083538 A1 5/2004 Thomas
2004/0111782 A1 6/2004 Lenormand et al.
2004/0197534 A1 10/2004 Miller et al.
2005/0124256 A1 6/2005 Mason et al.
2005/0159056 A1 7/2005 Lap et al.
2005/0249917 A1 11/2005 Trentacosta et al.
2006/0059601 A1 3/2006 Opitz et al.
2006/0135016 A1 6/2006 Iwasaki
2006/0165939 A1 7/2006 Hottner
2006/0185053 A1 8/2006 Wittmann et al.
2006/0240234 A1 10/2006 Oneill et al.
2007/0026186 A1 2/2007 Chapuis
2007/0083985 A1 4/2007 Nathan et al.
2007/0186832 A1 8/2007 Kishi et al.
2007/0245448 A1 10/2007 Bury
2007/0294800 A1 12/2007 Huang
2008/0005823 A1 1/2008 Hung
2008/0127395 A1 6/2008 Blauer et al.
2008/0289078 A1 11/2008 Mather
2008/0295216 A1 12/2008 Nordstrom et al.
2009/0089911 A1 4/2009 Smith
2009/0155543 A1 6/2009 Fowler
2009/0233042 A1 9/2009 Sadato et al.
2009/0314696 A1 * 12/2009 Trentacosta ..... G05D 23/19 210/97
2010/0030170 A1 * 2/2010 Keller ..... A61F 13/8405 604/360
2010/0122394 A1 5/2010 Lambertz
2010/0138977 A1 6/2010 Lin
2010/0143669 A1 6/2010 Abrams
2010/0281595 A1 11/2010 Gemes
2010/0287680 A1 11/2010 Johnson et al.
2010/0291825 A1 11/2010 Johnson et al.
2011/0072558 A1 3/2011 Bems
2011/0119811 A1 5/2011 Rock et al.
2011/0125125 A1 5/2011 Schneider et al.
2011/0296580 A1 12/2011 Demarest et al.
2011/0302686 A1 12/2011 Chapuis
2012/0005828 A1 1/2012 Mccullar et al.
2012/0005829 A1 1/2012 Waters et al.
2012/0005831 A1 1/2012 Waters et al.
2012/0017346 A1 1/2012 Reimer
2012/0114883 A1 * 5/2012 Kapur ..... B32B 38/04 428/101
2012/0222189 A1 9/2012 Sokolowski et al.
2012/0260396 A1 10/2012 Mordecai
2012/0328824 A1 12/2012 Cartabbia
2013/0014317 A1 1/2013 Ly
2013/0031703 A1 2/2013 Curtis
2013/0038104 A1 2/2013 Burns et al.
2013/0061366 A1 3/2013 Pezzimenti
2013/0177731 A1 7/2013 Moriarty
2013/0255103 A1 10/2013 Dua et al.
2013/0276201 A1 * 10/2013 Pezzimenti ..... A41D 13/002 2/69
2013/0277349 A1 10/2013 Pezzimenti
2014/0304896 A1 * 10/2014 Nordstrom ..... B32B 27/34 2/243.1
2014/0349057 A1 * 11/2014 Blackford ..... F16L 59/04 156/291
2015/0044943 A1 * 2/2015 Marshall ..... A41C 3/005 2/69
2016/0183613 A1 6/2016 Martin
2016/0213077 A1 * 7/2016 Sung ..... A41D 27/245
2016/0235147 A1 8/2016 Pezzimenti et al.
2016/0278459 A1 * 9/2016 Hilty ..... A41D 27/285
2016/0366962 A1 12/2016 Ilcheva et al.
2016/0366963 A1 * 12/2016 Koshkaroff ..... A41D 3/02
2017/0028669 A1 * 2/2017 Regester ..... A41D 3/00
2017/0065005 A1 * 3/2017 Nordstrom ..... A41D 27/10
2017/0099898 A1 4/2017 Pezzimenti
2017/0099899 A1 4/2017 Pezzimenti et al.
2017/0105467 A1 4/2017 Pezzimenti et al.
2017/0245560 A1 * 8/2017 Pezzimenti ..... B29C 66/729
2018/0098584 A1 * 4/2018 Pezzimenti ..... A41D 31/065
2018/0098586 A1 * 4/2018 Pezzimenti ..... A41D 27/24
2018/0098588 A1 * 4/2018 Pezzimenti ..... A41D 31/065
2019/0289939 A1 9/2019 Pezzimenti et al.
2019/0351094 A1 * 11/2019 Maher ..... A61L 15/18
2020/0000640 A1 * 1/2020 Mondal ..... A61F 13/00042
2022/0322772 A1 10/2022 Pezzimenti

FOREIGN PATENT DOCUMENTS

CN 2927724 Y 8/2007
CN 101209129 A 7/2008
CN 101731767 A 6/2010
CN 201782000 U 4/2011
CN 201929015 U 8/2011
CN 201999883 U 10/2011
CN 202122098 U 1/2012
CN 202233137 U 5/2012
CN 202293468 U 7/2012
CN 202368006 U 8/2012
CN 202375039 U 8/2012
CN 103358606 A 10/2013
CN 103750584 A 4/2014
CN 203969250 U 12/2014
CN 203986201 U 12/2014
CN 204132498 U 2/2015
CN 204340295 U 5/2015
CN 205072100 U 3/2016
CN 206182403 U 5/2017
EP 1325976 A2 7/2003
EP 2617306 A1 7/2013
EP 3358975 B1 9/2020
GB 2256359 A 12/1992
JP 60-152630 U 10/1985
JP 2001-192901 A 7/2001
JP 2004211905 A 7/2004
JP 2005-226173 A 8/2005
JP 2013-129940 A 7/2013
JP 3185237 U 7/2013
KR 10-2009-0113413 A 11/2009
KR 20-0454066 Y1 6/2011

(56) References Cited

FOREIGN PATENT DOCUMENTS

| | | | |
|---|---|---|---|
| KR | 20-0455836 | Y1 | 9/2011 |
| WO | 03/057975 | | 7/2003 |
| WO | 2004/082413 | A1 | 9/2004 |
| WO | 2013/070086 | A1 | 5/2013 |
| WO | 2014/062067 | A1 | 4/2014 |
| WO | 2014/087161 | A1 | 6/2014 |
| WO | 2017/062539 | A1 | 4/2017 |
| WO | 2018/046756 | A1 | 3/2018 |

OTHER PUBLICATIONS

Final Office Action received for U.S. Appl. No. 15/988,138, dated Feb. 28, 2022, 12 pages.
Non-Final Office Action received for U.S. Appl. No. 15/597,540, dated Mar. 4, 2022, 16 pages.
Office Action received for Canadian Patent Application No. 3,056,451, dated Mar. 2, 2022, 3 pages.
Office Action received for European Patent Application No. 21163471.2, dated Mar. 18, 2022, 6 pages.
Office Action received for Sri Lankan Patent Application No. 20396, dated Feb. 15, 2022, 1 page.
Final Office Action received for U.S. Appl. No. 15/597,540, dated Jun. 23, 2022, 15 pages.
Notice of Allowance received for U.S. Patent Application No. 15/255,603, dated Sep. 30, 2022, 10 pages.
Final Office Action received for U.S. Appl. No. 15/254,749, dated Jan. 13, 2022, 7 pages.
Non-Final Office Action received for U.S. Appl. No. 15/255,603, dated Jan. 12, 2022, 15 pages.
Notice of Allowance received for U.S. Appl. No. 15/254,749, dated Mar. 30, 2022, 9 pages.
Intention to Grant received for European Patent Application No. 17787759.4, dated Jun. 11, 2021, 5 pages.
Non-Final Office action received for U.S. Appl. No. 16/439,426, dated Jun. 8, 2021, 20 pages.
Office Action received for Canadian Patent Application No. 3001345, dated May 28, 2021, 4 pages.
Office Action received for Canadian Patent Application No. 3056451, dated Jul. 28, 2021, 3 pages.
Final Office Action received for U.S. Appl. No. 15/255,603, dated Oct. 28, 2021, 9 pages.
Final Office Action received for U.S. Appl. No. 15/286,929, dated Oct. 21, 2021, 15 pages.
Office Action received for European Patent Application No. 18729254.5, dated Nov. 3, 2021, 5 pages.
Intention to Grant received for European Patent Application No. 17787734.7, dated Sep. 24, 2021, 5 pages.
Notice of Allowance received for U.S. Appl. No. 16/439,426, mailed on Sep. 15, 2021, 7 pages.
Final Office Action received for U.S. Appl. No. 15/255,603, dated May 18, 2022, 14 pages.
Non-Final Office Action received for U.S. Appl. No. 16/924,781, dated Apr. 28, 2022, 26 pages.
Notice of Allowance received for Canadian Patent Application No. 3001345, dated May 3, 2022, 1 page.
Office Action received for European Patent Application No. 17765040.5, dated Jan. 24, 2023, 5 pages.
Office Action received for European Patent Application No. 17765042.1, dated Jan. 26, 2023, 5 pages.
Office Action received for European Patent Application No. 21163471.2, dated Jan. 24, 2023, 4 pages.
Final Office Action received for U.S. Appl. No. 16/924,781, dated Nov. 1, 2022, 22 pages.
Non-Final Office Action received for U.S. Appl. No. 15/597,540, dated Nov. 23, 2022, 12 pages.
Notice of Allowance received for Canadian Patent Application No. 3,056,451, dated Nov. 8, 2022, 1 page.
Office Action received for Canadian Patent Application No. 3,125,031, dated Oct. 28, 2022, 4 pages.
Notice of Allowance Received for U.S. Appl. No. 16/924,781, dated Mar. 23, 2023, 11 pages.
"78678 North End Sport Pursuit Ladies' 3-Layer Light Bonded Hybrid Soft Shell Jacket with Laser Perforation", Seasons Outfitters, Available on Internet at: <http://www.seasonsoutfitters.com/index.php/outerwear-32/waterproof/78678-pursuit-ladies-3-layer-light-bonded-hybrid-soft-shell-jacket-with-laser-perforation.html>, Accessed on Jan. 23, 2015, 1 page.
"88680: Ventilate—Men's Seam-Sealed Insulated Jacket", Alphabroder, Available on Internet at: <http://www.ashcity.com/en-ca/products/outerwear/insulated-seam-sealed/88680-ventilate-mens-nbsp-3bseam-sealed-insulated-jacket.html>, Accessed on Jan. 23, 2015, 2 pages.
Angie, "Trend: Quilted Textures", youlookfab, Available on Internet at: <http://youlookfab.com/2013/07/15/trend-quilted-textures/>, Jul. 15, 2013, 2 pages.
"Barbour Mens Chukka Quilted Jacket Military Brown Navy", Barbour, Available on Internet at: <http://www.coveredbridgecyclery.com/barbour-mens-chukka-quilted-jacket-military-brown-navy-1423.html>, Accessed on Jan. 23, 2015, 1 page.
Bendzovski, Daniel, "Trend-sandwich: Exploring New Ways of Joining Inspiration, Such as Different Kinds of Trends, Through Processes of Morphing and Melding Different Trendy Garments and Materials, for New Methods, Garment Types, Materials and Expressions", MA Fashion Design Thesis, University of Boras, 2015, 224 pages.
"C9 Loft Jacket", Houdini, Available on Internet at: <http://www.houdinisportswear.com/en/women/womens-c9-loft-jacket>, Accessed on Jan. 23, 2015, 1 page.
"Greenland Baffled Jacket", Marmot For Life, Available on Internet at: <http://marmot.com/products/details/greenland-baffled-jacket>, Accessed on Jan. 23, 2015, 1 page.
"Laser Perforated Jacket", Akris Punto, Nordstrom, Available on Internet at: <http://shop.nordstrom.com/s/akris-punto-laser-perforated-jacket/3667112>, Accessed on Jan. 23, 2015, 1 page.
"Mavic Helium Jacket (Men's)", MEC, Available on Internet at: <http://www.mec.ca/product/5038-526/mavic-helium-jacket-mens/>, Accessed on Jan. 23, 2015, 1 page.
"Nike Aeroloft", Nike, Available on Internet at: <http://www.nike.com/us/en_us/c/running/aeroloft>, Accessed on Jan. 23, 2015, 1 page.
"'Pizzoli' Knit & Quilted Jacket", Boss Hugo Boss, Nordstrom, Item #73989, Available on Internet at: <http://shop.nordstrom.com/s/boss-hugo-boss-pizzoli-knit-quilted-jacket/3782194>, Accessed on Jan. 23, 2015, 1 page.
"Quilted Front Down Sweater Jacket", Moncler, Nordstrom, Item #803724, Available on Internet at: <http://shop.nordstrom.com/s/moncler-quilted-front-down-sweater-jacket/3900159>. Accessed on Jan. 23, 2015, 1 page.
"Salomon Men's S-Lab Hybrid Jacket", Running Warehouse, Model No. L36344900, Available on Internet at: <http://www.runningwarehouse.com/Salomon_Mens_S-Lab_Hybrid_Jacket/descpage-SMSLHJ.html>, Accessed on Jan. 23, 2015, 1 page.
"Woman's Aconcagua Jacket", The North Face, Available on Internet at: <http://www.thenorthface.com/catalog/sc-gear/womens-jackets-vests/women-8217-s-aconcaguajacket.html?from=subCat&variationId=R8F &cm_mmc=Google-_-ProductListingAds-_-ProductTerms-_-The+North+Face+Women+s+Aconcagua+Jacket&gclid=Cj0KEQiAiuOIBRCU-8D6idaPz_UBEiQAzTagNG1Cj7lahwV8b1m5Eh-Q2W_EcYDilCjgsF8EXvFMbEaApbd8P8HAQ>, Accessed on Jan. 23, 2015, 1 page.
"Women's Better than Naked Cool Jacket", The North Face, Available on Internet at: <http://www.thenorthface.com/catalog/sc-gear/women-39-s-better-than-naked-cool-jacket.html>, Accessed on Jan. 23, 2015, 1 page.
Office Action received for European Patent Application No. 17765042.1, dated Mar. 23, 2021, 5 pages.
Notice of Allowance received for Canadian Patent Application No. 3036223, dated May 10, 2021, 1 page.

* cited by examiner

INSULATED GARMENT

CROSS-REFERENCE TO RELATED APPLICATIONS

This U.S. Non-Provisional Application No. 17/208,548, entitled "Insulated Garment," is a Divisional Application of U.S. Non-Provisional Application Ser. No. 15/724,702, entitled "Insulated Garment," and filed Oct. 4, 2017, which in turn claims the benefit of priority of U.S. Provisional Application No. 62/404,966, entitled "Insulated Garment," and filed Oct. 6, 2016. The entireties of the aforementioned applications are incorporated by reference herein.

TECHNICAL FIELD

Aspects herein are related to breathable insulated garments.

BACKGROUND

With the desire to stay active year round, there is a need for insulating garments for use during physical activity in the cooler months of the year. Conventional cold-weather garments employ down and/or synthetic fibers at different weights depending on the level of insulation desired.

BRIEF DESCRIPTION OF THE DRAWING

The technology described herein is described in detail below with reference to the attached drawing figures, wherein.

DETAILED DESCRIPTION

Figure 1A:
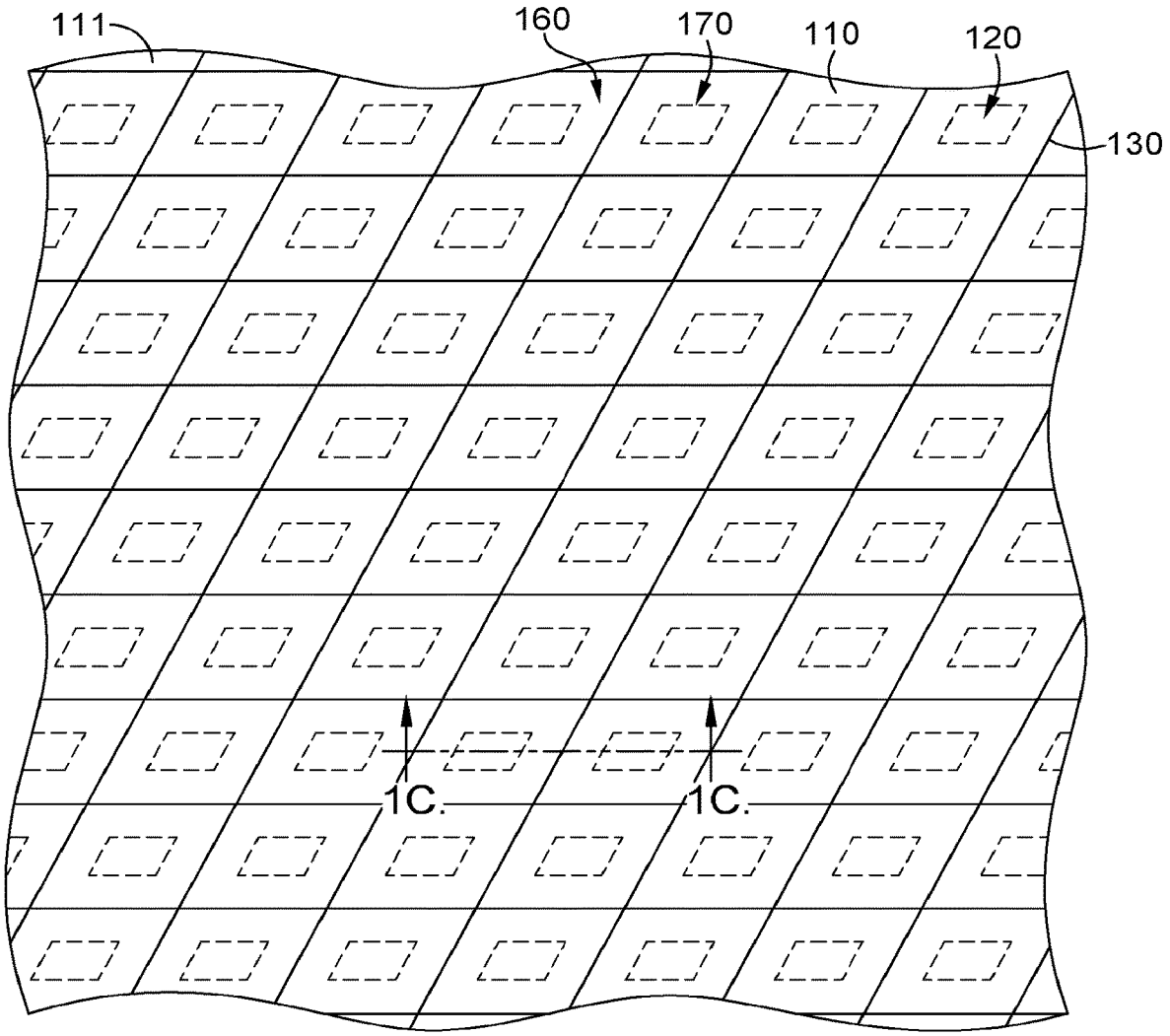
FIG. 1A is a partial view of an exemplary panel constructed in accordance with aspects herein.

The subject matter of the present invention is described with specificity herein to meet statutory requirements. However, the description itself is not intended to limit the scope of this disclosure. Rather, the inventors have contemplated that the claimed or disclosed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

At a high level, aspects herein relate to methods of constructing insulated garments and garments resulting therefrom. Traditionally, down has been the preferred insulation material due to its light weight and effective thermal insulation properties. However, care of down filled garments may be difficult and may need specialized laundering because of its tendency to clump up. Another potential disadvantage of down is that although its insulation properties are maintained when dry, if the down within the garment becomes wet for one reason or another, its insulation properties may become compromised and decrease significantly. Additionally, use of down often requires stitching panels of material together to form horizontally oriented chambers and blowing the down into the horizontally oriented chambers with specialized machinery, which can be a messy process.

Further, the cost of down may be high, depending on the quality of down. That is why alternatives to down such as cotton and polyfill fibers have been used. However, even though cotton and polyfill fibers may maintain their insulation properties better than down when wet, like down, cotton and polyfill fibers may also depend upon horizontally oriented chambers for an even distribution throughout the garment, and like down, may also have a tendency to clump up when wet or laundered. That is why most traditional insulated garments are formed from weatherproof materials to protect the wearer and the insulation materials from environmental elements such as, for example, rain and snow. However, traditional insulated garments formed from weatherproof materials may trap moisture vapor produced by the wearer, which may result in wearer discomfort.

One solution to the clumping of traditional thermally insulating materials when wet or after laundering has been to use non-woven polymer sheets instead of materials such as down or loose poly-fill fibers, for example. As used throughout this disclosure, terms such as "non-woven polymer sheet," "poly-fill sheet," "thermally insulating sheet material," and "thermally insulating fill sheet" may be used interchangeably herein. Further, as used throughout this disclosure, terms such as "sections of non-woven polymer material," "sections of poly-fill material," "sections of thermally insulating sheet material," and "sections of thermally insulating fill material" may be used interchangeably herein. These non-woven polymer sheets are easier to work with due to their cohesive structure. Further the use of non-woven polymer sheets or sections of non-woven polymer material imparts warmth to the finished garment, which may not be compromised when wet. Moreover, in some examples, the non-woven polymer materials described herein may be generally hypoallergenic, may not need special laundering, may have short dry times, and may still provide warmth even when wet. In some examples, they also may not need specialized handling or machinery when forming the garment which may potentially reduce manufacturing steps and/or costs. However, these sheets, depending on the amount of insulation desired, may become heavier than materials such as down. Therefore, the methods of constructing the insulated garments in accordance with the technology described herein, may utilize non-woven polymer sheets or sections of non-woven polymer material comprising one or more voided portions in order to make the resulting garments lightweight but still insulating.

Additional advantages may be obtained by using non-woven polymer sheets and/or sections of non-woven polymer material having voided portions. Because of their non-woven structure formed, for example, by entangling synthetic microfibers (i.e., fibers of one denier or less), synthetic fibers or filaments, a combination of synthetic and natural fibers or filaments, they are able to maintain a cohesive unitary structure as opposed to, for instance, loose poly-fill fibers and/or down. As such, they allow for the creation of voided portions in the non-woven polymer sheets, wherein the voided portions can take on any desired shape and size. Further, depending on the material used to form the garment layers, if the garment layers are formed from sheer, translucent, or in other words "see through" pliable materials, the presently described technology may become visible through the garment layers, thereby adding a visual appeal dimension to the final constructed garment.

Furthermore, the use of non-woven polymer sheets comprising one or more voided portions allows for the provision of varied levels of insulation within the same garment. For example, the level of insulation may be varied by changing the thickness of the thermally insulating sheet material at different locations, and/or the thermal insulation may be localized by providing insulated sections only at particular areas of the garment aligning with temperature sensitive areas in a wearer's body to provide insulation only where needed, thereby reducing garment bulkiness. In a different example, the level of insulation and/or the overall weight of the garment may be varied by adjusting the amount (e.g., volume, weight percent, and the like) of voided portions in the thermal insulation material. For example, increasing the amount (e.g., volume, weight percent, and the like) of voided portions in a thermally insulating sheet material may lead to a lighter overall weight of the garment as well as a decreased amount of thermal insulation provided by the thermally insulating sheet material. Further, in some examples, a first portion of a thermally insulating sheet material may have a first amount of voided portions and a second portion of the thermally insulating sheet material may have a second amount of voided portions where the first amount of voided portions is less than the second amount of voided portions thereby leading to an amount of thermal insulation of the first portion of the thermally insulating sheet material being greater than an amount of thermal insulation of the second portion of the thermally insulating sheet material.

In another exemplary aspect, garments constructed in accordance with aspects herein may be provided with one or more vent openings for allowing exchange of air, gas, heat, moisture, and the like, between an interior of the garment and an external environment of the garment. For example, garments constructed in accordance with aspects herein may be provided with one or more vent openings for allowing heat and moisture from perspiration to escape into an external environment thereby allowing an environment internal to the garment to stay regulated preventing discomfort from overheating. As another example, vent openings in a garment may contribute to an increased evaporation rate of sweat formed by a wearer of the garment thereby providing increased cooling to the wearer during certain conditions. In particular, providing the one or more vent openings may be advantageous when using water resistant or water repellant materials to form the garment layers because these materials may otherwise cause the heat and moisture from perspiration to become trapped within the garment, thereby making a wearer increasingly uncomfortable. The one or more vent openings in accordance with aspects herein may be provided evenly throughout the garment, or they may be provided at strategic areas of the garment to allow venting where needed most (i.e. areas aligning with areas of the body of a wearer that have higher heat and moisture release such as, armpits, lower back, upper back, and the like). Furthermore, the number, density, and/or size of the vent openings may be varied at different areas of the garment to provide different amounts of ventilation at different areas of the garment.

As described herein, use of a thermally insulating sheet material that comprises one or more voided portions also allows for the creation of a lightweight insulating garment. For example, the amount of thermal insulation material removed compared to its non-voided counterpart, may be measured as a weight percent. For example, when a piece of thermally insulating sheet material has a weight of 100 $g/cm^2$ and 10% by weight is removed from it to form one or more voided portions in the thermally insulating sheet material, 10 $g/cm^2$ are removed from the thermally insulating sheet material so that the thermally insulating sheet material having the one or more voided portions ends up weighing 90 $g/cm^2$, which may be the same weight or lighter than its down counterpart (down counterpart refers to, for example, a garment providing the same thermal insulation levels as a garment constructed with the thermally insulating sheet material having the one or more voided portions).

In accordance with aspects herein, the thermally insulating sheet material may have 5% by weight, 10% by weight, 20% by weight, 30% by weight, 40% by weight, 50% by weight, or between 5% and 60% by weight, between 15% and 50% by weight, between 25% and 45% by weight, between 20% and 35% by weight, between 10% and 25% by weight, and the like removed to form the one or more voided portions. The size and/or shape of the voided portions may be varied within a panel of thermally insulating sheet material, or the voided portions may be chosen to be of a uniform shape and/or size within the garment panel. Additionally, in some examples, different areas of the thermally insulating sheet material may have different weight percents removed to form different amounts of voided portions in the different areas of the thermally insulating sheet material.

Continuing, depending on the ability of a particular thermally insulating sheet material to hold its shape after multiple laundering cycles, the percent by weight removed from the thermally insulating sheet material to form the one or more voided portions may vary. For example, a thicker or denser (more tightly packed) thermally insulating sheet material may be more sturdy and withstand deformation better than a lighter weight or thinner thermally insulating sheet material. Another aspect that may play a role on the sturdiness of the thermally insulating sheet material may be, for example, the length of individual fibers used in the formation of the thermally insulating sheet material. In other words, the greater the length of individual fibers in the thermally insulating sheet material, the sturdier the thermally insulating sheet material may be. Therefore, it may be possible to form larger sized voided portions in the thicker and/or denser thermally insulating sheet material than in the lighter weight and/or thinner thermally insulating sheet material, or in the thermally insulating sheet material having individual fibers that are longer in length rather than the thermally insulating sheet material having individual fibers that are shorter in length.

In exemplary aspects, the thermally insulating sheet material may be reinforced so that it is better able to withstand repetitive wear, laundering, and the like. One way of reinforcing the thermally insulating sheet material may be by providing a scrim layer on one or both surfaces of the thermally insulating sheet material. The scrim layer may be adhesively bonded, heat bonded/fused, or both, to the thermally insulating sheet material. The thermally insulating sheet material may also be reinforced by heat treating one or both surfaces of the thermally insulating sheet material to form a skin layer on the heat treated surface(s). The skin layer may be formed by partially or fully fusing together the surface fibers forming the thermally insulating sheet material.

Alternatively or in addition to one or more of the reinforcing methods described above, the thermally insulating sheet material in accordance with aspects herein, may be stabilized within a garment construction through the provision of one or more non-garment/article forming seams securing the thermally insulating sheet material to one or both garment layers (one garment layer on either surface of the thermally insulating sheet material), at portions of the thermally insulating sheet material that correspond to non-voided portions in the thermally insulating sheet material. In one aspect, the greater the number of non-garment/article forming seams used to secure the thermally insulating sheet material to one or both garment layers, the greater its stability and the better it is able to maintain its structural integrity when subjected to, for example, laundering and repeated use, thereby being less subjective to deformation and/or warping. However, the number of non-garment/article forming seams that may be needed to stabilize the thermally insulating sheet material within garment layers may be decreased when the voided thermally insulating sheet material comprises a high enough density and/or is reinforced. For instance, when the voided thermally insulating sheet material is considered to be structurally sound, a fewer number of tack points may be needed to hold the voided thermally insulating sheet material in place with respect to the garment layers in the finalized garment. Additionally, the higher density thermally insulating sheet material and/or the reinforced thermally insulating sheet material may be able to accommodate larger voided portions than the lighter density thermally insulating sheet material and/or non-reinforced thermally insulating sheet material.

In accordance with the technology described herein, in a method of construction that utilizes non-woven polymer sheets or thermally insulating sheet materials, one or more selected portions of the thermally insulating sheet materials may be removed to create one or more openings or voided portions in the thermally insulating sheet material prior to or after shaping the thermally insulating sheet material according to specifications for at least one garment panel. The one or more openings or voided portions may be created by, for example, manual cutting, die cutting, laser cutting, ultrasonic cutting, and the like. An advantage of using laser or ultrasonic cutting may be that internal perimeter edges of each of the one or more voided portions may become sealed by the formation of, at least in part, a skin layer resulting from the fusion of at least a portion of surface fibers in the internal perimeter edges of the one or more voided portions. The skin layer may contribute to the structural integrity of each opening or voided portion in the thermally insulating sheet material. Alternatively, the one or more openings or voided portions may be integrally formed when manufacturing the thermally insulating sheet material. Further, at least two garment forming layers of pliable material may be provided, also according to the specifications for the at least one garment panel. The voided thermally insulating sheet material may be interposed between the two layers of pliable material forming a "sandwich" configuration for the at least one garment panel, resulting in the voided thermally insulating sheet material as a second layer of thermally insulating sheet material "sandwiched" between a first layer of pliable material and a third layer of pliable material.

In accordance with aspects herein, the second layer of thermally insulating sheet material may be first aligned with and secured to one of the first layer of pliable material or the third layer of pliable material at one or more portions corresponding to non-voided portions of the second thermally insulating sheet material through one or more non-garment/article forming seams or tack points. The other of the first layer of pliable material or the third layer of pliable material that is not secured, may be positioned adjacent the second layer of thermally insulating sheet material, such that the second layer of thermally insulating sheet material is positioned between the first layer of pliable material and the third layer of pliable material. Alternatively, the first layer of pliable material, the second layer of thermally insulating material and the third layer of pliable material may be secured to each other at one or more portions corresponding to non-voided portions of the second thermally insulating sheet material through one or more non-garment/article forming seams or tack points to form the at least one garment panel. The at least one garment panel may be used at least in part to form the garment.

In a First Realization in Accordance with Aspects Herein:

Garments that are produced according the method described above may be light weight, low maintenance, versatile and may have thermal insulation properties that perform similar to or better than their down counterparts, for example. The garments may have a first layer and a third layer of pliable material with a second layer of thermally insulating sheet material interposed between the first layer and the third layer of pliable material, where the second layer of thermally insulating sheet material comprises one or more voided portions. The second layer of thermally insulating sheet material may be secured to one of the first layer of pliable material or the third layer of pliable material, or may be secured to both the first layer of pliable material and the third layer of pliable material through one or more non-garment/article forming seams formed at one or more portions corresponding to non-voided areas in the second layer of thermally insulating sheet material.

In a Second Realization in Accordance with Aspects Herein:

Further, the garments described herein may be configured to allow moisture and/or heat to escape from the garment through one or more vent openings. The one or more vent openings may be formed on an affixed portion of the first layer of pliable material and the third layer of pliable material, the one or more vent openings extending through the first and third layers of pliable material at the affixed portion. The affixed portion may be formed by affixing a first portion of an interior surface of the first layer of pliable material and a corresponding second portion of an interior surface of the third layer of pliable material that are in alignment with at least one voided portion in the one or more voided portions of the second layer of thermally insulating sheet material. The affixing step may be performed by adhering the interior surfaces of the first layer and the third layer of pliable material. Alternatively, the one or more affixed portions may be formed by stitching the first and the third layers of pliable materials together forming boundaries for each affixed portion. And in yet another aspect, the one or more affixed portions may be formed by both adhering the interior surfaces of the first and third layers of pliable material and by adding stitching to boundaries of the affixed portions, thereby reinforcing each affixed portion in the one or more affixed portions.

In a Third Realization in Accordance with Aspects Herein:

The technology described herein is further directed to insulated garments having zonal insulation, or in other words, garments that comprise insulation sections that are located at specific locations on the garment. The individual insulation sections may be constructed as described in the method of construction above, but in place of a whole garment panel, each individual insulation section may have a size that is smaller than the garment panel onto which it will be installed. Furthermore, each insulation section may have a specific shape suitable for adequate coverage and protection to a specific body part of a wearer. The insulation sections according to aspects herein may be installed on an outer surface of a garment layer by for example, stitching or otherwise bonding a perimeter of each insulation section to the outer surface of the garment at specified locations, thereby adding an additional visual appeal to the garment. A particular garment may comprise one or more insulation sections installed on to it. When multiple insulation sections are installed on one garment, each insulations section may be adequately sized and shaped according to particular specifications for the garment and its particular location on the garment. For example, a chest insulation section may be configured to be larger than a shoulder insulation section, or a collar insulation section.

As such it is envisioned that garments comprising the thermal insulation sections in accordance with aspects herein, are geared to provide localized thermal insulation to only certain areas of a wearer's body that may be more sensitive to temperature changes, without having to wear a fully insulated garment in the form of a jacket/coat. Exemplary garments that may include the insulation sections in accordance with the aspects described herein include: biking gear, running gear, and the like, that is meant to be conforming to a wearer's body. Specific examples will be discussed below with reference to the figures.

The insulation section, like the garment panels constructed in accordance with aspects herein, may further comprise one or more vent openings to form vented-insulation sections. When vented, the insulation sections may allow moisture and/or heat to escape from the garment through one or more vent openings formed through the insulation sections. Each insulation section may comprise, for example, a first layer and a third layer of pliable material with a second layer of thermally insulating sheet material having one or more voided portions interposed between the first layer and the third layer of pliable material. The vent openings, if provided, may be formed in affixed portions by bonding a first portion of an interior face of the first layer of pliable material and a corresponding second portion of an interior face of the third layer of pliable material that are in alignment with at least one voided portion in the one or more voided portions of the second layer of thermally insulating sheet material to form at least one affixed portion. Then, one or more vent openings may be formed at the affixed portion that extend through all layers of the affixed portion.

In a Fourth Realization in Accordance with Aspects Herein:

The garments in accordance with aspects herein may comprise integrally woven garment panels, each garment panel having, for example, a first woven layer of pliable material with a first inner surface and a first outer surface, a second woven layer of pliable material comprising a second inner surface and a second outer surface, and a woven layer of thermal insulation integrally woven with and interposed between the first woven layer and the second woven layer of pliable material, wherein the woven layer of thermal insulation comprises, for example, a plurality of float yarns.

Further, the integrally woven layers of the garment panel may comprise one or more integrally woven affixed portions at one or more portions not comprising the float yarns. In other words, the first layer of pliable material and the second layer of pliable material are integrally woven together to form a single layer of pliable material at the affixed portion. Optionally, one or more openings may be formed through one or more of the affixed portions to form one or more vent openings. The vent opening may be, for example, integrally formed in the weaving process, it may be laser cut post weaving, or it may be die cut post weaving. It is envisioned that many other methods of forming the vent openings are available, and they are all considered to be within the scope according to aspects described herein.

In a fifth realization in accordance with aspects herein:

The garments in accordance with aspects herein may comprise integrally knit garment panels, each garment panel having, for example, a first knit layer of pliable material with a first inner surface and a first outer surface, a second knit layer of pliable material comprising a second inner surface and a second outer surface, and a knit layer of thermal insulation integrally formed from and interposed between the first knit layer and the second knit layer of pliable material, wherein the knit layer of thermal insulation comprises, for example, tie yarns, loops (i.e. like in a terry fabric), and the like.

Further, the integrally knit layers of the garment panel may comprise one or more integrally knit affixed portions at one or more portions not comprising the tie yarns and/or the yarn loops. In other words, the first layer of pliable material and the second layer of pliable material are integrally knit together to form a single layer of pliable material at the affixed portion. Optionally, one or more openings may be formed through one or more of the affixed portions to form one or more vent openings. The vent opening may be, for example, integrally formed in the knitting process, it may be laser cut post knitting, or it may be die cut post knitting. Like in the woven example above, it is envisioned that many other methods for forming the vent openings are available, and they are all considered to be within the scope according to aspects described herein.

Materials of Construction

The garments in accordance with the technology described herein may be constructed using natural woven or knit fabrics (e.g., cotton, silk, hemp, etc.) synthetic woven or knit fabrics (e.g., polyester, rayon, etc.), non-woven materials (e.g., leather, faux leather, pliable plastics, rubbers, thermoplastics, polymer materials, and the like) and/or combinations thereof. The woven or knit fabrics may be optionally treated with down/fill-proofing chemical treatments, and/or water repellants that may also act as down/fill-proofing treatments, such chemical treatments referred to as DWR (durable water repellant). Although DWR is a waterproofing chemical treatment, in addition to waterproofing the fabric, it is also very useful for down/fill-proofing fabrics, especially light and ultra-light weight fabrics. For example, fabrics that may particularly benefit from DWR treatment are light fabrics (89 $g/m^2$ to 30 $g/m^2$) and ultra-light fabrics (29 $g/m^2$ or lighter). Heavier fabrics, such as fabrics with weights in the range of 90 $g/m^2$ to 149 $g/m^2$ or even 150 $g/m^2$ to 250 $g/m^2$ or higher, may be inherently more resistant to fill/down and may or may not need a chemical treatment depending on the specific type of fabric/textile and therefore, may not need to be treated with a down/fill proofing chemical treatment.

Both heavy and light-weight fabrics may be used in garments in accordance with the technology described herein. Lighter weight fabrics may be more desirable in the manufacture of athletic and/or insulating garments used during high aerobic activity, in order to minimize the garments' weight.

Form Factor

The insulated garment described herein can take several forms. In one example of the garment in accordance with the technology described herein, the garment may be a standalone garment. The garment may be in the form of a vest covering a person's body core area, a jacket or coat with sleeves, pants, a total body suit, ski pants, a fleece, a clothing liner, and the like.

Alternatively, the garment in accordance with the technology described herein may be used as a removable interior-insulating panel having an exterior shell which may or may not be weather proof. This interior-insulating panel may also be worn as a standalone garment when detached from the exterior shell Like in the previous example, the removable interior-insulating panel may be presented as a vest, a jacket, a body suit, and the like, depending on the type of garment and protection desired. For example, if the exterior shell is a long sleeved jacket, the interior-insulating panel may be presented as a vest, a jacket, or a jacket with removable sleeves to convert into a vest, depending on the amount of insulation desired. The interior-insulating panel may be fastened to the exterior shell by a zipper mechanism, buttons, hook-and-loop fasteners, or other suitable fastening mechanism or combination of fastening mechanisms.

The garments in accordance with aspects herein may be worn over or engineered into a base layer, such as in the case of a vest. In other words, instead of being removable, an exterior insulating panel in accordance with the technology described herein may be permanently attached to the base layer by using, for example, stitching, bonding, welding, and the like or by integrally forming the garment layer by, for example, knitting or weaving. Moreover, the garments may be engineered into an exterior shell. In other words, instead of being removable, an interior insulating panel in accordance with the technology described herein may be permanently attached to the exterior shell. This may be achieved by permanently affixing the exterior shell to the interior insulating panel at one or more areas using, for instance, stitching, bonding, welding, adhesives, and the like. Alternatively, an interior insulating panel may be integrated into an exterior shell panel by, for instance, integrally forming the interior insulating panel with the exterior shell using an engineered knitting and/or weaving process. Further, the breathability of the garment panels described above, may be increased by providing one or more vent locations at predetermined areas of the garment panel. Any and all aspects, and any variation thereof, are contemplated as being within the scope herein.

Definitions

As used throughout this disclosure, positional terms used when describing, for instance, a garment, such as "anterior," "posterior," "inferior," "superior," "lateral," "medial," and the like are to be given their common meaning with respect to the garment being worn by a hypothetical wearer standing in anatomical position.

Unless indicated otherwise, terms such as "affixed," "coupled," "secured," and the like may mean releasably affixing two or more elements together using for instance, structural differences between elements, releasable adhesives, snaps, buttons, hook-and-loop fasteners, and the like. These terms may also mean permanently affixing two or more elements together using, for example, stitching, bonding, adhesives, welding, and the like.

Unless indicated otherwise, terms such as "proximate" or "adjacent" may mean within 0 cm to 5.0 cm of a designated reference point.

Exterior panel: As used herein the phrase "exterior panel" describes a panel on the exterior of the garment. The exterior panel may be exposed to the external environment, or may not be exposed to the environment, for example, if the garment is worn under another garment or layer.

Affixed portion: a portion of an interior surface of a first layer of pliable material affixed by stitching, bonding, welding, and the like, to an interior surface of a second layer of pliable material, at a location on the first and second layers of pliable material aligning with a voided portion in a layer of thermally insulating sheet material interposed between the first and the second layers of pliable material. The first layer of pliable material, the layer of thermally insulating sheet material, and the second layer of pliable material are in alignment when they are layered, for example, on top of each other in the z-direction, and are extending along an x,y-plane. In other words, the alignment of the interior surface of the first layer of pliable material and the interior surface of the second layer of pliable material with a voided portion in the thermally insulating sheet material occurs, for example, in the z-direction, where the interior surfaces of the first and second layers of pliable material are able to be affixed to each other to form the affixed portion without any interference from the thermally insulating sheet material. The affixed portions are configured to help anchor the thermally insulating material to prevent shifting of the thermally insulating material, and to maintain the structural integrity of the thermally insulating material, due to repeated use and especially during laundering cycles.

Vent opening: As used herein the phrase describes an opening that is formed on an affixed portion or a seam, and extends through the first layer of pliable material and the second layer of pliable material at the affixed portion or seam, thereby directly or indirectly connecting an interior environment internal to the garment (near a wearer's body when the garment is worn), to an exterior environment external to the garment (exposed to environmental elements). The vent opening may be formed at a central area or central portion of the affixed portion. The central area is one that is, for example, located equidistant from respective vertices of the affixed portion when the affixed portion comprises a shape having linear sides, or is located at the center of the affixed portion when the affixed portion comprises, for instance, a circular shape.

Interior panel: As used herein the phrase "interior panel" describes a panel inside of or interior to the exterior panel. A garment may have multiple interior panels.

Voided portion/area: As used herein the phrases "voided portion," and/or "voided area" describe an opening, a hole, or an empty space (only air is present). The voided portions in the thermally insulating sheet material in accordance with aspects herein, may be formed by, for example, manual cutting, die cutting, laser cutting, ultrasonic cutting, and the like. An advantage of using laser or ultrasonic cutting may be that internal perimeter edges of each of the one or more voided portions may become sealed by the formation of, at least in part, a skin layer resulting from the fusion of at least a portion of surface fibers in the internal perimeter edges of the one or more voided portions. The skin layer may contribute to the structural integrity of each opening or voided portion in the thermally insulating sheet material. Alternatively, the voided portions of the thermally insulating sheet material in accordance with aspects herein, may be formed during the manufacturing of the thermally insulating sheet material to create a thermally insulating sheet material having one or more voided portions.

Non-voided portion/area: As used herein the phrase "non-voided portion," and/or "non-voided area" describe the tangible portion or area surrounding an opening, a hole, or an empty space (only air is present). The non-voided portions/areas in the thermally insulating sheet material in accordance with aspects herein, are the tangible portions or areas in the thermally insulating sheet material that surround the voided portions in the thermally insulating sheet material. In other words, the non-voided portions/areas, comprise the tangible sections of the material that provide structural integrity to the material.

Water-Resistant Fabric: As used herein "water-resistant fabric" is a fabric that is substantially impervious to water. In some exemplary aspects, the term "water-resistant fabric" may be defined as a fabric that has greater than 1,000 mm of water resistance, which is the amount of water, in mm, which can be suspended above the fabric before water seeps through. However, values above and below this threshold are contemplated as being within the scope herein.

Non-breathable Fabric: As used herein "non-breathable fabric" is fabric that exhibits a low rate of moisture vapor transmission. In some exemplary aspects, a fabric may be defined as being non-breathable when it has a moisture vapor transmission rate less than 1000 ($g/m^2/d$), which is the rate at which water vapor passes through the fabric, in grams of water vapor per square meter of fabric per 24-hour period ($g/m^2/d$). However, values above and below this threshold are contemplated as being within the scope herein.

Weather-Resistant Fabric: As used herein "Weather-Resistant Fabric" is a fabric that is generally resistant to water and/or wind. In some instances, a weather-resistant fabric may comprise a fabric that is substantially impervious to water and exhibits a low rate of moisture vapor transmission.

Passage: As used herein the term "passage" is a space between garment layers where the garment layers are not directly connected. The passage is configured to and allows for the passage of moisture or moisture vapor and/or air.

Insulation section: As used herein refers to a pod-type construction wherein a first/interior layer of pliable material and/or a second/exterior layer of pliable material are affixed to a voided thermally insulating sheet material disposed between them. The pod type construction is configured to cover only a portion of an exterior surface of a garment, for example, less than 70% of an exterior surface of the garment, between 20% and 50% of an exterior surface of the garment, between 30% and 60% of an exterior surface of the garment, and the like.

First/interior layer/panel: As used herein refers to a layer of pliable material comprising a first/exterior surface and an opposite second/interior surface where the first/exterior surface is configured to face toward a body surface of a wearer when the garment is worn, and where the second/interior surface is configured to face toward a thermally insulating material contained within a chamber.

Second/exterior layer/panel: As used herein refers to a layer of pliable material comprising a first/exterior surface and an opposite second/interior surface where the first/exterior surface is configured to face toward an external environment, away from the body surface of a wearer when the garment is worn, and where the second/interior surface is configured to face toward a thermally insulating material contained within a chamber.

Seam: As used herein refers to a tack or stitched point; a stitched line; a quilting stitch; adhered/fused/bonded point/area/portion/section; and/or adhered/fused/bonded line, to join or secure two or more layers of material together, or two or more garment/article panels.

Garment/article forming seam: As used herein, a garment/article forming seam is a seam that is configured to join two or more garment/article panels together to form a garment/article. More specifically, garment/article forming seams, as used herein, are configured to join two or more garment/article panels at their respective edges to form the garment/article. Examples of garment/article forming seams may comprise seams that join sleeve panels to body panels of an upper body garment, seams that join front and back panels of an upper or lower body garment, and the like.

Non-garment/article forming seam: As used herein, a non-garment/article forming seam is a seam that does not join two or more garment/article panel edges together but rather, secures two or more layers (e.g., inner, outer, and/or middle layers) of a single garment/article panel to each other. Non-garment/article forming seams help to improve the structural stability of the garment/article panel and may be present alone or in combination with one or more affixed portions, as described above. The non-garment/article forming seams may be formed by, for example, stitching the different layers of the garment/article panel to each other and/or by using an adhesive or bonding material to adhere the layers together. Non-garment/article forming seams may further add visual interest to the garment panel when in the form of, for example, embroidery.

Baffle: As used throughout this disclosure, the term "baffle" may be defined as a chamber formed by, for example, the first layer of pliable material and the second layer of pliable material where the chamber encloses one or more voided portions of a layer of thermally insulating sheet material that is placed between first layer of pliable material and the second layer of pliable material, where the chamber is delineated by the one or more seams.

Non-woven: As used throughout this disclosure, the term "non-woven" may be defined as a mat or sheet-like structure formed by entangling microfibers, fibers, or filaments of a material, or depositing filaments of a material into a mold to form a cohesive sheet-like structure. The polymer sheet may comprise a single layer or multiple layers.

As briefly described above, aspects herein contemplate a method of forming an insulated vented garment using non-woven polymer sheets such as a thermally insulating poly-fill sheet. Aspects herein further contemplate an insulated vented garment formed using non-woven polymer sheets. In exemplary aspects, the polymer material may comprise a single layer or multiple layers. Further, in exemplary aspects, the polymer material may comprise polyester microfibers, fibers, or filaments. The non-woven polymer sheet is made to be lighter than a conventional non-woven polymer sheet through the formation of one or more voided portions in the non-woven polymer sheet. As such, aspects of the present technology allow for the provision of good insulation properties due to heated air in between garment layers (heated by a wearer's intrinsic body heat) being trapped and able to circulate in the one or more voided portions and in between the entangled fibers forming the non-woven polymer sheet.

The voided thermally insulating sheet material in accordance with aspects herein is highly versatile, light weight, and durable, without sacrificing its thermally insulative properties. In fact, depending on the weight (thickness) of the thermally insulating sheet material, its insulative properties may be comparable or better than down, while remaining lightweight. Furthermore, the voided thermally insulating sheet material allows for a more versatile garment construction not restricted to horizontally extending baffles, as is the case with down or loose synthetic fibers. Moreover, the voided thermally insulating sheet material in accordance with aspects herein reduces the bulkiness of garments without sacrificing insulation, thereby allowing for garment constructions that are less restrictive, breathable, hypoallergenic (no animal products such as down), and visually appealing. The air present in the voided portions may also allow for a more even heat convection and distribution throughout the garment. Additionally, the technology in accordance with aspects herein allows for the provision of different levels of insulation within a single garment panel by, for example, varying the thickness of the thermally insulating sheet material at different regions of the garment and/or varying the size and/or frequency of the voided portions in the thermally insulating sheet material within the same garment panel.

In exemplary aspects, the insulating garment may be manufactured from a light-weight fabric. In some examples, the light-weight fabric may be a translucent (see through) light weight fabric, which allows the viewing of the materials positioned underneath the translucent light-weight fabric or textile, thereby, also adding a visual dimension to the garments. Seams separating chambers or pockets may be located at various areas of the garment, spaced at varying intervals, and may have any orientation and/or shape. In another aspect, one or more portions of the insulating zones and/or the vented garment may be constructed using a weaving or knitting process (e.g., a weaving or knitting machine may be programmed to form various structures or constructions described herein). For example, such weaving or knitting processes may be used to form a seamless or nearly seamless garment or portions thereof.

Turning now to FIG. 1A, a partial view of an exemplary garment panel 100 constructed in accordance with aspects of the present technology is illustrated. In the partial view of the garment panel 100, it can be observed that the garment panel 100 comprises at least a first layer of pliable material 111 (shown), a second layer of thermally insulating sheet material 121 (seen in FIG. 1B) and a third layer of pliable material 131 (seen in FIG. 1B), positioned adjacent to each other such that one or more of their respective surfaces are in contact with each other. In the partial view of the exemplary garment panel 100, a plurality of voided portions 120 are shown by the dashed lines 170. As will be illustrated further in FIG. 1B, the voided portions 120 are formed in the second layer of thermally insulating sheet material 121. In exemplary aspects, the second layer of thermally insulating sheet material 121 may be secured to only the first layer of pliable material 111, only to the third layer of pliable material 131, or both the first layer of pliable material 111 and the third layer of pliable material 131 (shown in FIG. 1C) through one or more seams 130 formed through one or more non-voided portions 160 in the second layer of thermally insulating sheet material 121, thereby forming one or more baffles 110, for example, by stitching, tacking, bonding, or any other suitable method. As used throughout this disclosure, the term "baffle" may be defined as a chamber formed by, for example, the first layer of pliable material 111 and the third layer of pliable material 131 where the chamber encloses one or more voided portions 120 in the second layer of thermally insulating sheet material 121 and where the chamber is delineated by the one or more seams 130. For example, as depicted in FIG. 1A, the second layer of thermally insulating sheet material 121 is shown as being affixed to the first layer of pliable material 111 by one or more seams 130, thereby defining a plurality of baffles 110. In the example shown in FIG. 1A, each of the one or more baffles 110 encloses a respective voided portion 120 of the second layer of thermally insulating sheet material 121.

Figure 1B:
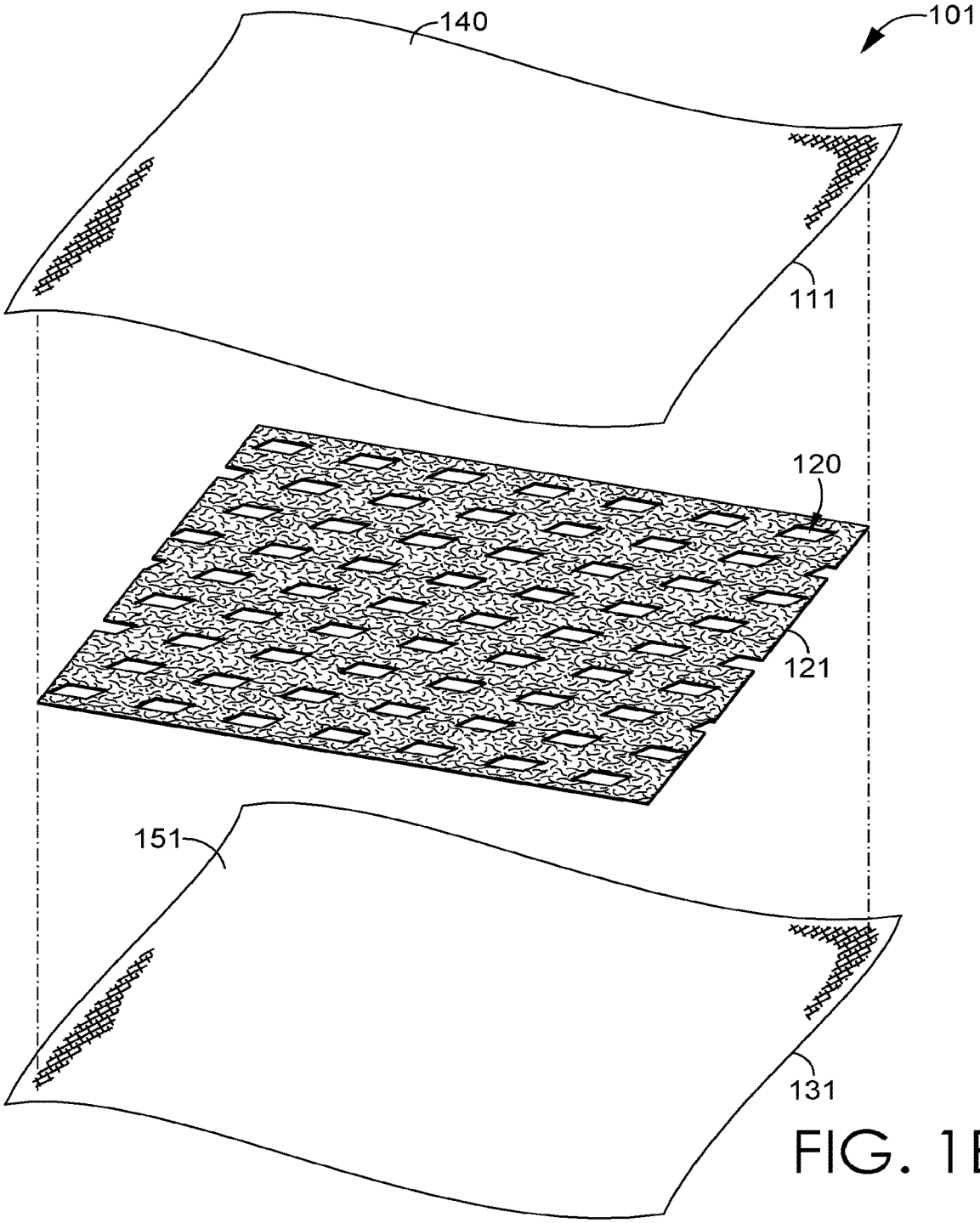
FIG. 1B is an exploded/deconstructed view of the exemplary panel shown in FIG. 1B in accordance with aspects herein.

FIG. 1B shows an exploded/deconstructed view 101 of the partial view of the garment panel 100 of FIG. 1A in accordance with aspects herein. As seen in FIG. 1B, the first layer of pliable material 111 comprises a first/external surface 140 (shown) and a second/internal surface 141 (shown in FIG. 1C.) Likewise, the third layer of pliable material 131 comprises a first/external surface 150 (shown in FIG. 1C) and a second/internal surface 151 (shown). As shown, the second layer of thermally insulating sheet material 121 comprises a plurality of voided portions 120, and is generally interposed or positioned between the first layer of pliable material 111 and the third layer of pliable material 131, with one surface of the second layer of thermally insulating sheet material 121 facing the second/internal surface 141 of the first layer of pliable material 111, and the other surface of the second layer of thermally insulating sheet material 121 facing the second/internal surface 151 of the third layer of pliable material 131.

According to the present example, the voided portions 120 in the second layer of thermally insulating sheet material 121 are evenly spaced and comprise a uniform size and shape throughout. However, it is contemplated that the second layer of thermally insulating sheet material 121 may be manufactured with one or more voided portions of any desired shape and size, suitable for the particular garment construction at hand. Alternatively, or in addition to, the one or more voided portions 120 may be formed on the second layer of thermally insulating sheet material 121 by, for example, manual cutting, die cutting, laser cutting, ultrasonic cutting, and the like. An advantage of using laser or ultrasonic cutting may be that internal perimeter edges of each of the one or more voided portions 120 may become sealed by the formation of, at least in part, a skin layer resulting from the fusion of at least a portion of surface fibers in the internal perimeter edges of the one or more voided portions 120. The skin layer may contribute to the structural integrity of each opening or voided portion 120 in the thermally insulating sheet material 121. The one or more voided portions 120 may be formed to have a desired shape and size suitable for use in accordance with aspects herein.

Figure 7:
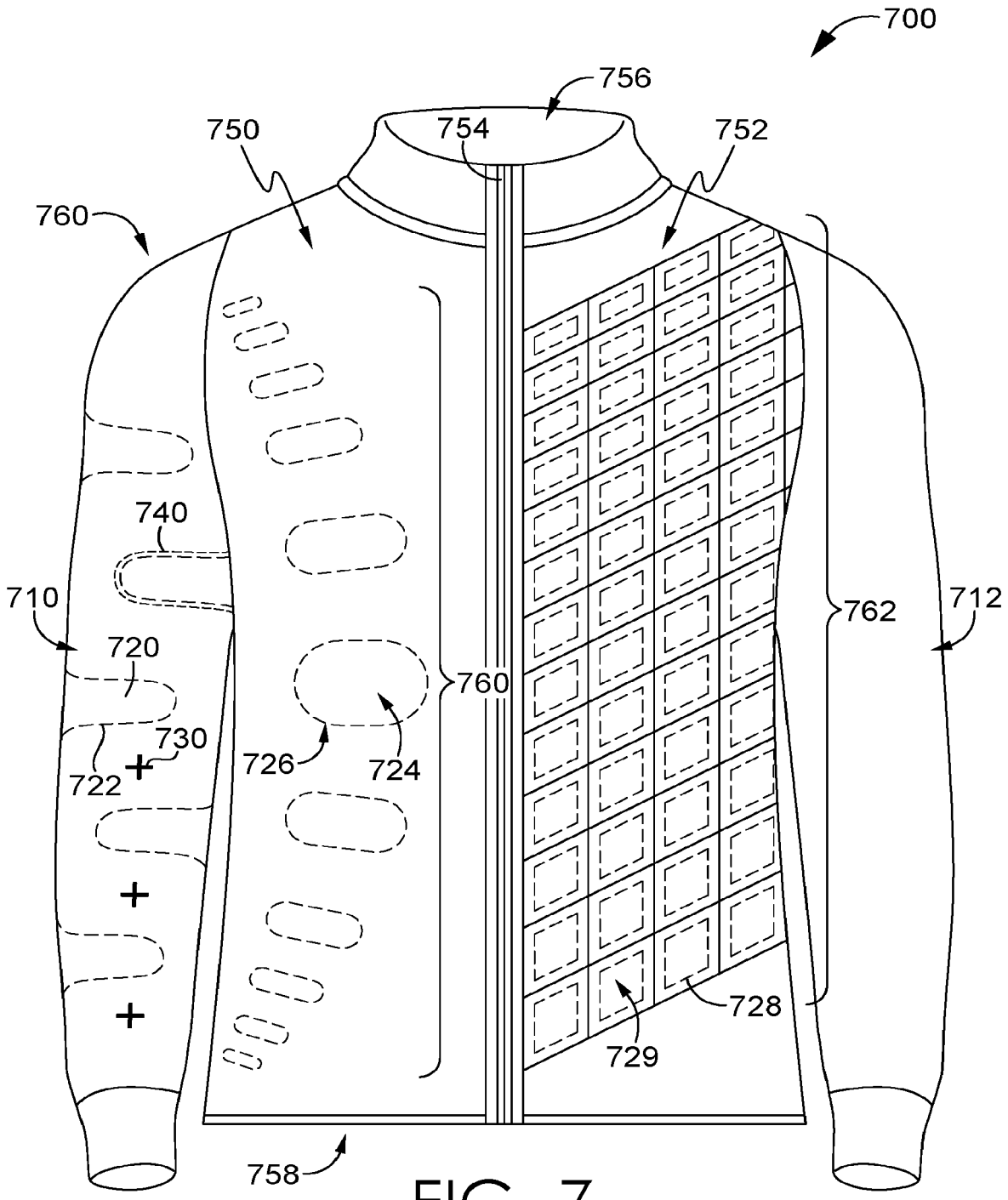
FIG. 7 is a front view of another exemplary garment constructed in accordance with aspects herein.

The one or more voided portions 120 may, for example, have a uniform shape and size throughout the second layer of thermally insulating sheet material 121 (as shown in FIG. 1B), or the one or more voided portions 120 may be formed to have a uniform shape but different sizes at different locations on the second layer of thermally insulating sheet material 121, for example, creating a size gradient (as shown in an exemplary garment in FIG. 7). Alternatively, the one or more voided portions 120 may have different shapes and/or sizes at different locations on the second layer of thermally insulating sheet material 121 (as shown, for example, in FIGS. 2A, 2B, and 1E). For example, the one or more voided portions 120 in a first location on the second layer of thermally insulating sheet material 121 may comprise a first shape and/or size and a second shape and/or size at a second location on the second layer of thermally insulating sheet material 121. The one or more voided portions 120 may, for example, have geometric shapes such as a circle, square, parallelogram, triangle, hexagon, octagon, and the like. Alternatively or in addition, the one or more voided portions 120 may, for example, have other graphic shapes such as star, moon, heart, letters, and the like. Further, the one or more voided portions 120 may, for example, have curvilinear/unique/organic shapes, as is observable, at least, in FIG. 1E, where a partial view of a partial garment panel 104 is shown with curvilinear/organically shaped voided portions 120 in the second layer of thermally insulating sheet material 121.

The second layer of thermally insulating sheet material 121 may be tacked to one of the first layer of pliable material 111 or the third layer of pliable material 131, or both the first layer of pliable material 111 and the third layer of pliable material 131 at one or more discrete tack points in place of, or in addition to, the continuous seams 130, shown with respect to FIG. 1A. The one or more discrete tack points may be formed for example, by tack stitching at one or more portions on the first and/or third layers of pliable material 111 and 131 corresponding to the non-voided portions 160 of the second layer of thermally insulating sheet material 121. Although tack stitching is described, it is also contemplated herein that the tack points may be formed by, for example, bonding, spot welding, use of spot adhesives, use of a discontinuous adhesive sheet, and the like. In one aspect a plurality of discrete tack points (non-continuous stitching) may be used to create particular patterns at the one or more portions on the first and/or third layers of pliable material 111 and 131 corresponding to the non-voided portions 160 of the second layer of thermally insulating sheet material 121. Such patterns may include, for example, a logo, a geometric pattern, an organic pattern, and the like.

In an additional or alternative aspect, the one or more tack points may be formed at portions on the first and/or third layers of pliable material 111 and 131 corresponding to one or more voided portions 120 of the second layer of thermally insulating sheet material 121. This is accomplished by adhesively or otherwise, bonding the second/internal surfaces 141 and 151, respectively, at the one or more voided portions to form one or more affixed portions. Similar to the tack stitching, the locations of the affixed portions may be strategically chosen to form a desired pattern. In accordance with aspects herein, the affixed portions may provide a further advantage in that they may serve as locations for one or more vent openings that will be described in further detail below.

The one or more voided portions 120 in accordance with aspects herein, may range in size between for example, 0.1 cm-100 cm, 0.5 cm-50 cm, 1 cm-25 cm, 2 cm-10 cm, 0.1 cm-10 cm, 0.5 cm-5 cm, and the like, measured on the tallest or widest side of the voided portion 120 from a starting point on one side of the voided portion 120 to an ending point on the other side of the voided portion 120. As described above, the voided portions 120 may be formed to have a size gradient. For example, the voided portions 120 may be round voids having a diameter ranging from 0.1 cm-3 cm, with the biggest voided portion 120 having the biggest diameter being present in a first area of the garment and the smallest voided portion 120 having the smallest diameter being present at a second area of the garment, with intermediately sized voided portions 120 located between the biggest and the smallest voided portions 120.

Having voided portions of different sizes at different locations on the garment can be used to add a visual effect when the technology is made to be visible and/or to vary the level of insulation at the different locations (even when the technology is not made to be visible). This is because the level of insulation can be adjusted by the removal of thermally insulating material from the second layer of thermally insulating sheet material 121, after a threshold value is reached. For example, the insulation provided by a layer of thermally insulating material may not be particularly different between a non-voided state and a 10% by weight voided state. However, the level of insulation provided by the layer of thermally insulating material may slightly decrease starting at a 15% by weight voided state. It can be appreciated that the threshold value will be different for different types of thermally insulating sheet materials depending on the composition and or weight/thickness of the thermally insulating sheet material used. Another advantage of the garment construction in accordance with aspects herein is that the air present in the voided portions 120 of the second layer of thermally insulating sheet material 121 may aid in heat distribution and retention of heat by allowing the air located around the second layer of thermally insulating sheet material 121 and in between the first layer of pliable material 111 and the third layer of pliable material 131, to be warmed by the wearer's body heat and to be evenly distributed throughout the garment.

The one or more voided portions 120, along with having the functionality of providing varied levels of insulation (after the threshold value is reached), may also provide a visual effect for the garment. In particular, the visual effect may be achieved when using pliable materials that are translucent, see through, or almost see through, as the garment layers. For example, the first layer of pliable material 111 may be used as an exterior translucent garment layer, which would allow the voided portions 120 in the second layer of thermally insulating sheet material 121 to be viewed through the first layer of pliable material 111. In other aspects, both the first and the third layers of pliable material 111 and 131 may be made of translucent material. The translucent pliable materials may comprise, for example, ultra-thin/knit woven textiles such as nylon, thermoplastic materials, clear plastic-type materials, and the like.

As described above, in some cases textiles that are ultra-thin may need to be chemically treated to make them resistant to the fill material penetrating the textile, either partially or entirely. An exemplary treatment may include, for example, a durable water repellant (DWR). Additionally, in accordance with aspects herein, the textiles in accordance with the present disclosure may be formed, for example, by weaving or knitting a textile of sufficient weight to retain the fill material. As such both of the first layer of pliable material 111 and the third layer of pliable material 131 may comprise an ultra-thin textile material treated with DWR. Alternatively, when the first layer of pliable material 111 is an exterior layer, it may comprise the translucent textile/fabric layer, while the third layer of pliable material 131 (since it is an interior layer) may comprise a moisture regulation knit or woven synthetic textile/fabric, a mesh type fabric, a soft natural textile/fabric (cotton, hemp), and the like. It is contemplated that these are merely exemplary configurations and that there are many other configurations possible, which would still be within aspects herein.

Figure 1C:
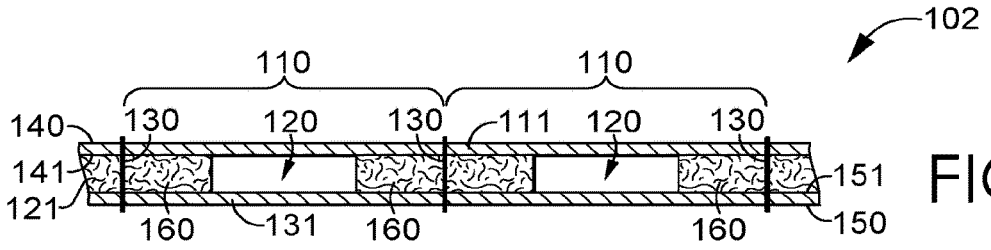
FIG. 1C is a cross-sectional view along the line 1C-1C in FIG. 1A in accordance with aspects herein.

Moving on to FIG. 1C, FIG. 1C shows a cross-sectional view 102 of the garment panel 100 in FIG. 1A along the line 1C-1C in accordance with aspects herein. As observed from FIG. 1C, each baffle 110 encloses a respective voided portion 120 in the second layer of thermally insulating sheet material 121 positioned between the first layer of pliable material 111 and the third layer of pliable material 131. As seen in this example, each baffle 110 is delimited by seams 130 formed on non-voided portions 160 of the second layer of thermally insulating sheet material 121, where each of the seams 130 secures the first layer of pliable material 111 to the second layer of thermally insulating sheet material 121 and to the third layer of pliable material 131. In this particular example, the seams 130 will be visible on first/external surfaces 140 and 150 of the first layer of pliable material 111 and the third layer of pliable material 131 respectively. Each second/internal surface 141 and 151 of the first layer of pliable material 111 and the third layer of pliable material 131 respectively, is in contact with one of the opposing surfaces of the second layer of thermally insulating sheet material 121.

Figure 1D:
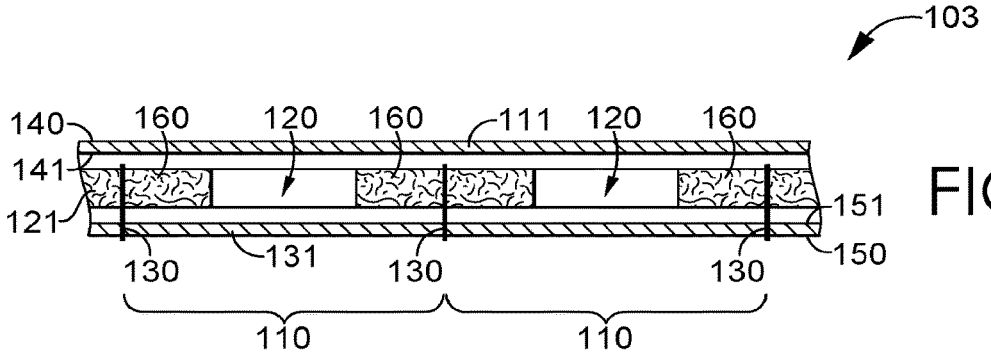
FIG. 1D is a cross-sectional view of a different configuration for the exemplary panel shown in FIG. 1A along the line 1C-1C in FIG. 1A in accordance with aspects herein.

FIG. 1D shows a cross-sectional view 103 of a different configuration for the garment panel 100 of FIG. 1A in accordance with aspects herein. As observed from FIG. 1D, each baffle 110 encloses a respective voided portion 120 of the second layer of thermally insulating sheet material 121 positioned between the first layer of pliable material 111 and the third layer of pliable material 131. As seen in this example, each baffle 110 is delimited by seams 130 formed on non-voided portions 160 of the second layer of thermally insulating sheet material 121, where each of the seams 130 secures the second layer of thermally insulating sheet material 121 only to the third layer of pliable material 131. However, it is envisioned that the second layer of thermally insulating sheet material 121 may be secured to only the first layer of pliable material 111, in a further aspect herein. Further, it is envisioned that the seams 130 will be visible on the external surface (in the illustrated example) 150 of the third layer of pliable material 131. Each second/internal surface 141 and 151 of the first layer of pliable material 111 and the third layer of pliable material 131, respectively, are in contact with one of the surfaces of the second layer of thermally insulating sheet material 121. However, the first layer of pliable material 111 in this example, is essentially free from any securement points that would tack it to the second layer of thermally insulating sheet material 121 and the third layer of pliable material 131. As described above the seams 130 may comprise tack points, or the seams 130 may comprise longer stitch lines or otherwise formed longer seam formations.

Figure 1E:
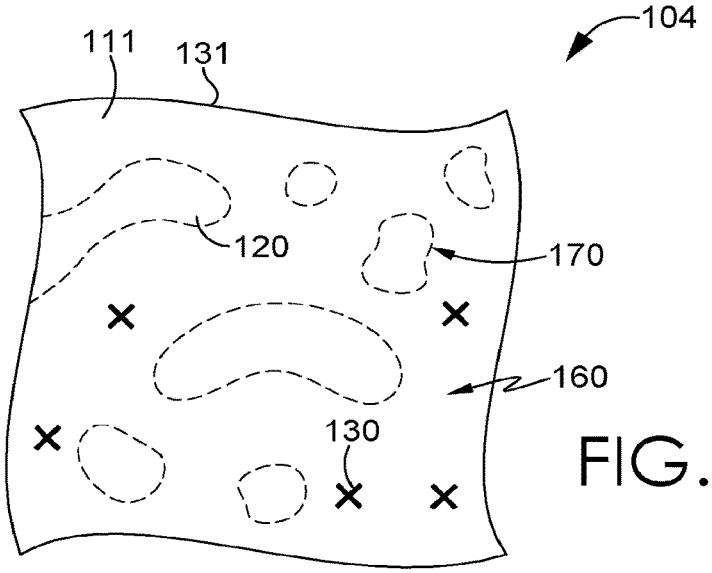
FIG. 1E is a partial view of an exemplary garment panel in accordance with aspects herein.

In FIG. 1E, a partial view of an exemplary garment panel 104 constructed in accordance with aspects of the present technology is illustrated in accordance with aspects herein. In the partial view of the garment panel 104, it can be observed that the garment panel 104 comprises at least a first layer of pliable material 111 (shown), a second layer of thermally insulating sheet material similar to the second layer of thermally insulating sheet material 121 (seen in FIG. 1B) and a third layer of pliable material similar to the third layer of pliable material 131 (seen in FIG. 1B), positioned adjacent to each other such that one or more of their respective surfaces are in contact with each other. In the partial view of the garment panel 104, a plurality of voided portions 120 are shown by the dashed lines 170. As illustrated, the voided portions 120 are formed in the second layer of thermally insulating sheet material. In this example, the one or more voided portions 120 comprise curvilinear/organic shapes that are randomly sized and distributed throughout the second layer of thermally insulating sheet material. As described, in exemplary aspects, the second layer of thermally insulating sheet material may be secured to only the first layer of pliable material 111, only to the third layer of pliable material, or both the first layer of pliable material 111 and the third layer of pliable material through one or more tack seams 130 formed through one or more non-voided portions 160 in the second layer of thermally insulating sheet material. The one or more tack seams 130 may also be randomly distributed (as shown) or, they may be arranged to form a pattern such as, for example, a logo.

Figure 2A:
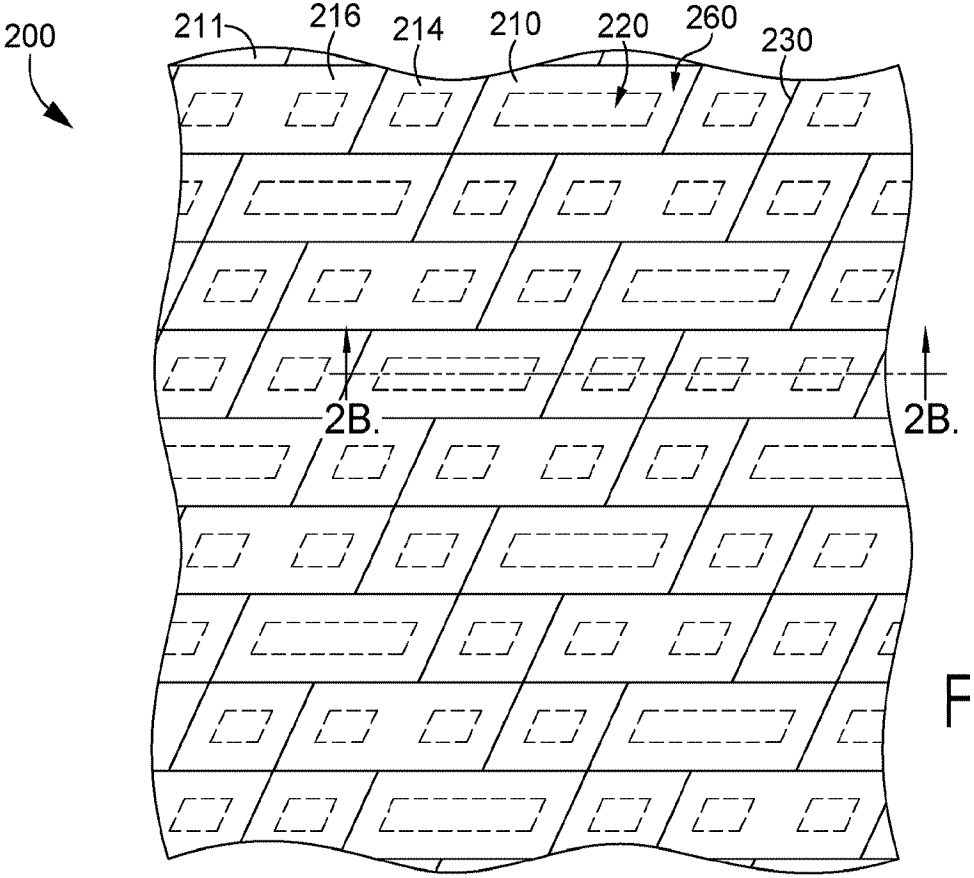
FIG. 2A is a partial view of an exemplary panel constructed in accordance with aspects of the present invention in accordance with aspects herein.

Turning now to FIG. 2A, a partial view of another exemplary garment panel 200 is provided, where the garment panel 200 is constructed in accordance with aspects of the present technology. In the partial view of the garment panel 200, it can be observed that the garment panel 200 comprises a first layer of pliable material 211 (shown), a second layer of thermally insulating sheet material 221 (seen in FIG. 2B), and a third layer of pliable material 231 (seen in FIG. 2B), positioned adjacent to each other such that one or more of their respective surfaces are in contact with each other. In the partial view of the exemplary garment panel 200, a plurality of voided portions 220 formed in the second layer of thermally insulating sheet material 221 are shown by the dashed lines. In this aspect, the voided portions 220 comprise a number of different shapes and sizes at different locations on the second layer of thermally insulating sheet material 221. The second layer of thermally insulating sheet material 221 may be secured to only the first layer of pliable material 211 (shown), only to the third layer of pliable material 231, or both the first layer of pliable material 211 and the third layer of pliable material 231 (shown in FIG.

2B) through one or more seams 230 formed, for example, by stitching, tacking, or any other suitable method. The one or more seams 230 are formed through one or more non-voided portions 260 in the second layer of thermally insulating sheet material 221, thereby forming one or more baffles 210, 214, 216. In the example shown in FIG. 2A, baffle 210 encloses one voided portion 220 having a first size, baffle 214 encloses one voided portion 220 having a second size, and baffle 216 encloses two voided portions 220 having the second size. As such, it can be observed that many other configurations are possible and are still within the scope of the present disclosure. For example, each baffle 210, 214, or 216 may be formed to enclose three, four, five, ten, and the like number of voided portions 220 in the second layer of thermally insulating sheet material 221. Additionally, the voided portions 220, in addition to being of different sizes, may also comprise different types of shapes such as other geometric shapes than the one shown, other curvilinear/organic shapes, and the like and would still fall within aspects of the present technology.

Figure 2B:
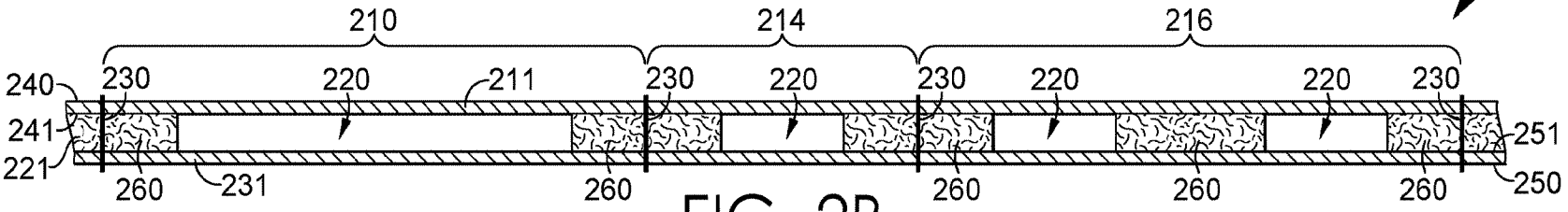
FIG. 2B is a cross-sectional view along the line 2B-2B in FIG. 2A in accordance with aspects herein.

FIG. 2B shows a cross-sectional view 202 of the garment panel 200 in FIG. 2A along the line 2B-2B in accordance with aspects herein. As discussed above and as observed from FIG. 2B, each baffle 210, 214, 216 may enclose a different number of voided portions 220 having different shapes and sizes in the second layer of thermally insulating sheet material 221, where the second layer of thermally insulating sheet material 221 is positioned between the first layer of pliable material 211 and the third layer of pliable material 231. As seen in FIG. 2B, each baffle 210, 214, and 216 is delimited by one or more seams 230, formed on non-voided portions 260 of the second layer of thermally insulating sheet material 221, where each of the one or more seams 230 secures the first layer of pliable material 211 to the second layer of thermally insulating sheet material 221 and to the third layer of pliable material 231. In this particular example, the one or more seams 230 will be visible on external surfaces 240 and 250 of the first layer of pliable material 211 and the third layer of pliable material 231 respectively. Each inner surface 241 and 251 of the first layer of pliable material 211 and the third layer of pliable material 231 respectively, are in contact with one of the surfaces of the second layer of thermally insulating sheet material 221.

Figure 3A:
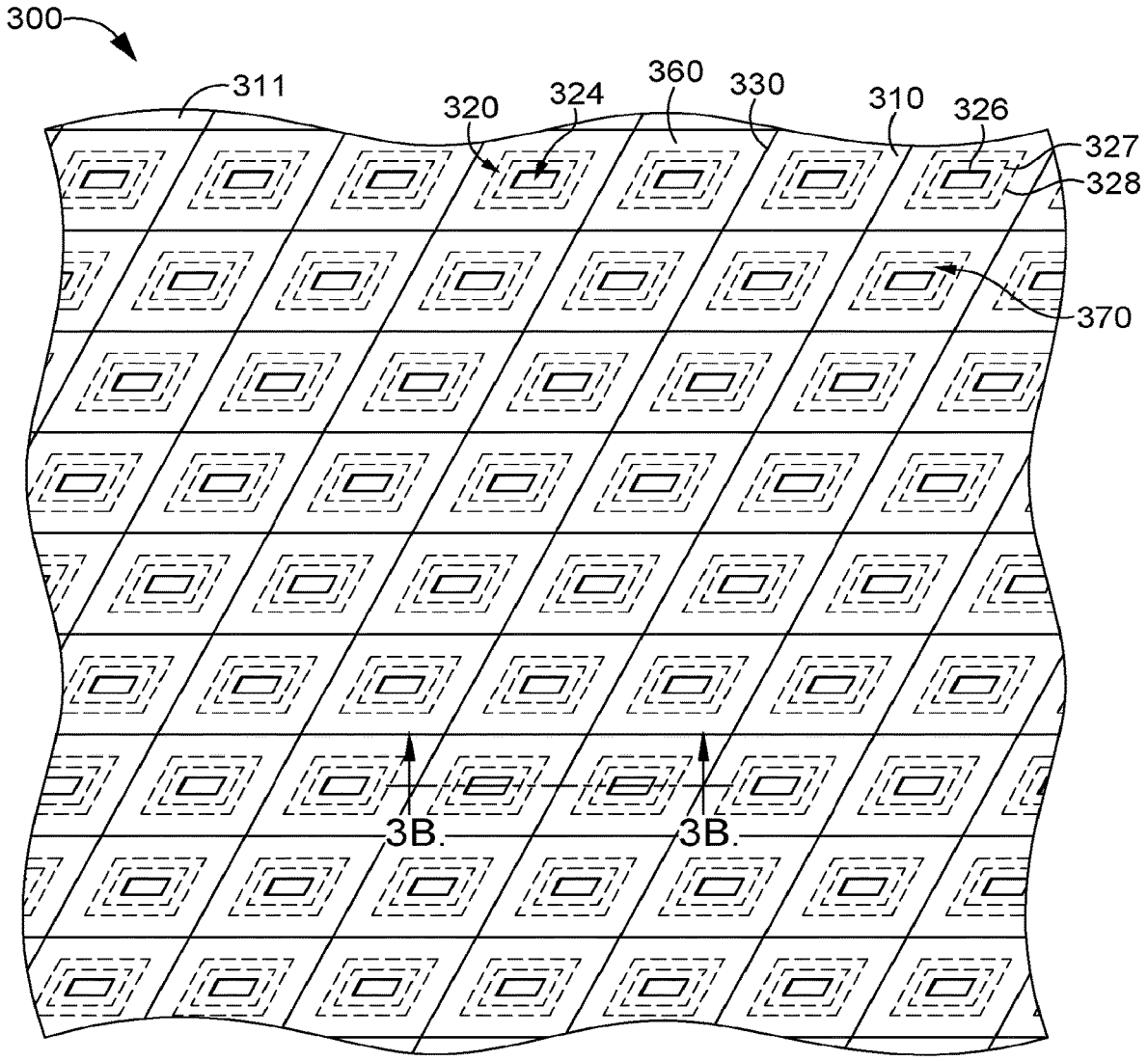
FIG. 3A is a partial view of an exemplary panel constructed in accordance with aspects of the present invention in accordance with aspects herein.
Figure 3B:
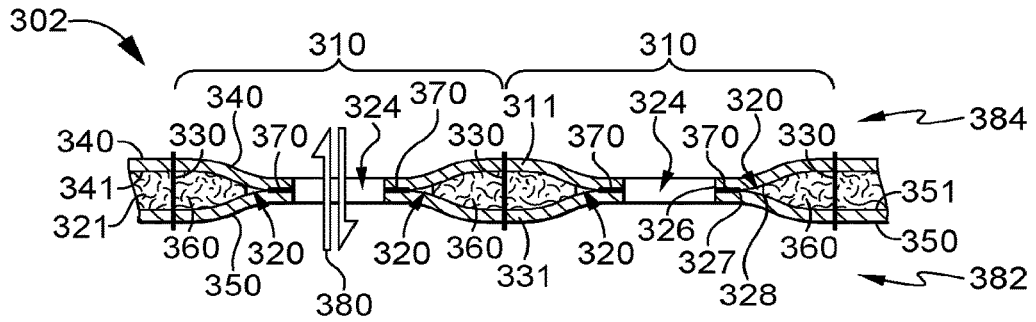
FIG. 3B is a cross-sectional view along the line 3B-3B in FIG. 3A in accordance with aspects herein.

Turning now to FIG. 3A, a partial view of another exemplary garment panel 300 is provided, where the garment panel 300 is constructed in accordance with aspects of the present technology. In the partial view of the garment panel 300, it can be observed that the garment panel 300 comprises a first layer of pliable material 311 (shown), a second layer of thermally insulating sheet material 321 (seen in FIG. 3B) and a third layer of pliable material 331 (seen in FIG. 3B), positioned adjacent to each other such that one or more of their surfaces are in contact with each other. In the partial view of the exemplary garment panel 300, a plurality of voided portions 320 are shown by the dashed lines defining an edge/perimeter 328 for each of the voided portions 320 formed in the second layer of thermally insulating sheet material 321. Further, the garment panel 300 may comprise one or more affixed portions 370 delimited by edge/perimeter 327, wherein the one or more affixed portions 370 may comprise areas where an interior surface 341 of the first layer of pliable material 311 is affixed to an interior surface 351 of the third layer of pliable material 331. This may be accomplished by way of an adhesive (activatable, for example, by pressure, heat, ultrasonic energy, etc.), and/or by fusing (using heat or ultrasonic energy) the first layer of pliable material 311 to the third layer of pliable material 331 at areas corresponding to one or more of the voided portions 320 in the second layer of thermally insulating sheet material 321. Furthermore, one or more vent openings 324 may be formed through one or more of the affixed portions 370, each vent opening 324 being delimited by edge/perimeter 326. The one or more vent openings 324, in accordance with aspects herein, may be used to aid in heat regulation and moisture regulation within the garment panel 300 when the garment is worn by a wearer. In other words, the one or more vent openings 324 form a communication passage (shown in FIG. 3B) that allows a two-way air flow 380 between a first environment 382 and a second environment 384 as shown in FIG. 3B. For example, when a person exercises, one possible physiological response is to cool down the body by releasing heat and moisture in the form of perspiration. Perspiration still occurs in cold weather and might increase when a person wears heat-insulating garments. Therefore, the one or more vent openings 324 described herein allow for an insulating garment that may protect a wearer from external environmental conditions, while still allowing moisture from perspiration to escape to the exterior environment. In addition, the technology may regulate an interior temperature of the garment by facilitating a transfer of heat through the garment.

In accordance with aspects herein, the second layer of thermally insulating sheet material 321 may be secured to only the first layer of pliable material 311 (shown) or only to the third layer of pliable material 331, through one or more seams 330, for example, formed by stitching, tacking, adhesives, welding, or any other suitable method. Or the second layer of thermally insulating sheet material 321 may be secured to both the first layer of pliable material 311 and the third layer of pliable material 331 (as shown in FIG. 1C) through the one or more seams 330 where the seams 330 are formed through one or more non-voided portions 360 in the second layer of thermally insulating sheet material 321, thereby forming one or more baffles 310.

With respect to FIG. 3B, FIG. 3B shows a cross-sectional view 302 of the garment panel 300 in FIG. 3A along the line 3B-3B in accordance with aspects herein. As observed from FIG. 3B, each of the one or more baffles 310 encloses a respective voided portion 320 delimited by edge/perimeter 328 of the second layer of thermally insulating sheet material 321, one affixed portion 370 delimited by edge/perimeter 327 and one vent opening 324 delimited by edge/perimeter 326. However, it is contemplated that many other arrangements are possible where the one or more affixed portions 370 may be formed on only certain areas of the garment and/or wherein the one or more vent openings 324 may be formed on only some of the one or more affixed portions 370 at particular predetermined locations, or wherein the one or more vent openings 324 may be formed on each of the affixed portions 370 confined to particular locations of the garment. In different exemplary garments, the baffles 310 may enclose one or more voided portions 320, regardless of whether there is a vent opening 324 formed in that baffle 310. The one or more vent openings 324, as briefly described above, allow for a two-way air flow 380 between first environment 382 and second environment 384.

As further observed, the second layer of thermally insulating sheet material 321 is interposed or positioned between the first layer of pliable material 311 and the third layer of pliable material 331. As seen in this example, each baffle 310 is delimited by one or more seams 330 formed on non-voided portions 360 of the second layer of thermally insulating sheet material 321, where each of the one or more seams 330 secures the first layer of pliable material 311 to the second layer of thermally insulating sheet material 321 and to the third layer of pliable material 331. In this particular example, the seams 330 will be visible on external surfaces 340 and 350 of the first layer of pliable material 311 and the third layer of pliable material 331 respectively. Each interior surface 341 and 351 of the first layer of pliable material 311 and the third layer of pliable material 331 respectively, are in contact with one of the surfaces of the second layer of thermally insulating sheet material 321.

It is within an aspect of the present disclosure that the garment panel 300 partially shown in FIG. 3A, may be used as part of a reinforced construction. For example, lighter/thinner thermally insulating sheet materials may tend to undergo deformation after one or more laundering cycles. As such, a layer of pliable material comprising a plurality of openings corresponding with the one or more voided portions of the thermally insulating sheet material, may be secured onto one or both sides of the thermally insulating sheet material by a plurality of seams to form a plurality of baffles, as shown. This reinforced construction may then be interposed between two garment layers and secured to the two garment layers at, for example, garment forming seams, or at one or more non-garment forming seams, such as those described with reference to the figures above, to secure the reinforced construction to only one, or both of the garment layers. In accordance with aspects herein, this reinforcing technique may further be employed to add visual effects to the finalized garment when the garment layers are made to be translucent (i.e. nearly transparent/see through). For example, the layers of pliable material in the reinforced construction may comprise patterns, colors, textures, and the like that are viewable through the translucent garment layers.

Figure 4A:
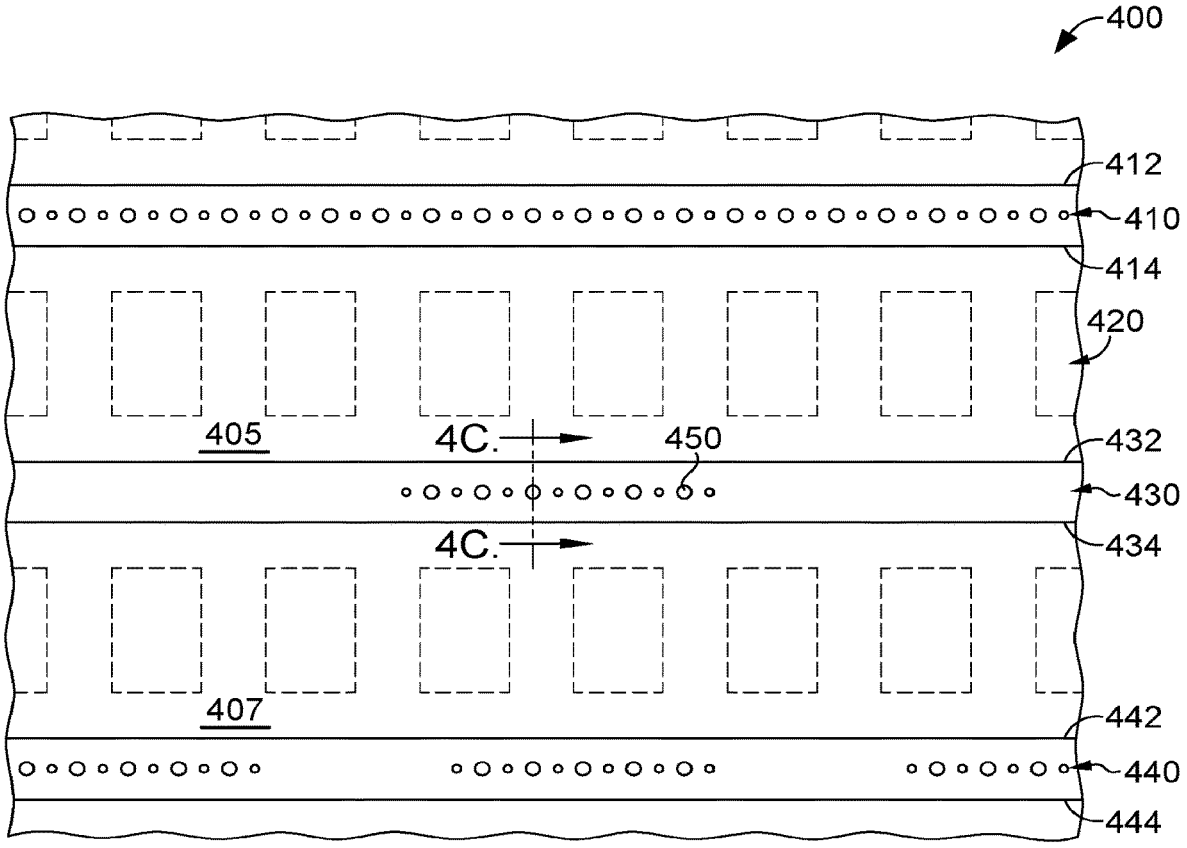
FIG. 4A is a partial view of an exemplary panel having a first configuration constructed in accordance with aspects herein.

FIG. 4A is a view of another exemplary partial panel 400 formed according to the technology described herein. The partial panel 400, like in the panels discussed above in reference to FIGS. 1A-3B, comprises at least a first layer of pliable material, at least a second layer of pliable material, and a thermally insulating sheet material having a plurality of voided portions, interposed or positioned between the at least first layer of pliable material and the at least second layer of pliable material (in order to simplify the description, the individual layers forming the panels are not referenced with a number in this figure). As described above, the layers of pliable material may be knit or woven to make them down or fill proof and/or the layer of pliable material may be water-repellent and/or fill proof fabrics, or alternatively, such as in the case of, for example, light-weight fabrics, the layers of pliable material may be treated with waterproofing and/or down-proofing chemicals such as, for example, the chemical treatments referred to as DWR (durable water repellent). Since the garments in accordance with aspects herein are insulated garments, the layers of pliable material, whether chemically treated or not, can prevent the fill from poking through and may help prevent water moisture from the environment from entering inside of the garment. However, a downside of these fill proof fabrics or chemical treatments is that these treatments may decrease the ability for moisture vapor to evaporate from an environment that is internal to the garment, when the garment is worn by a wearer.

Therefore, in accordance with aspects herein, a plurality of perforations 450 can be provided at the seams securing/joining at least the first and the second layers of pliable material together, where the plurality of perforations 450 are shown on each of the seams 410, 430, and 440, and extend through the first layer and the second layer of pliable material to form a two-way passage between an environment internal to the garment and an environment external to a formed garment when the garment is worn by a wearer. The seams 410, 430, and 440 may, for example, be formed by sewing along a top margin and a bottom margin defining the respective seam 410, 430, or 440, or alternatively, the seams 410, 430, and/or 440 may be formed by adhering internal surfaces of both garment layers together using an adhesive tape having a particular width, and/or, the seams 410, 430, and/or 440 may be formed by adhering/fusing the garment layers together with or without an adhesive, depending on the type of material used for the garment layers. In addition to adhering/fusing the garment layers together, there may be stitching added along one or both seam boundaries 412, 414, 432, 434, 442, and 444 for each seam 410, 430, and 440 respectively. Any and all aspects, and any variation thereof, are contemplated as being within aspects herein.

In the exemplary view of the partial panel 400 shown in FIG. 4A, one or more perforations 450 are provided on seam 410 such that the perforations 450 extend along the length of the seam 410, where the one or more perforations 450 may comprise a uniform size, or different sizes and/or shapes, as shown. Baffle 405 is defined, for example, by the second/lower seam boundary 414 of the seam 410 and the first/upper seam boundary 432 of seam 430. In this example, there are multiple voided portions 420 in the thermally insulating sheet material enclosed by the baffle 405.

Alternatively, as shown on seam 430, only a discrete number of perforations 450 may be provided on and through the seam 430, depending on the location of the seam 430 on a formed garment. To put it another way, instead of extending along the length of the seam as with the seam 410, perforations 450 may be formed on only a portion of the seam 430. Similar to seam 410, seam 430 comprises a first/upper seam boundary 432 and a second/lower seam boundary 434, with the one or more perforations 450 being provided within the seam boundaries 432 and 434.

In yet a different example, as shown in seam 440, the one or more perforations 450 may be provided intermittently along the length of the seam 440 to form a repeating pattern. The one or more perforations 450 extend through the seam 440 and are located within a first/upper seam boundary 442 and a second/lower seam boundary 444 of the seam 440. The garment in accordance with aspects herein, may comprise multiple baffles in each garment panel. For example, the lower seam boundary 434 of seam 430 and the upper seam boundary 442 of seam boundary 440, may define baffle 407, also enclosing multiple voided portions 420 in the layer of thermally insulating sheet material, within the baffle 407.

In exemplary aspects, the seams 410, 430, and 440 may be spaced apart in a generally horizontal orientation on the partial panel 400 as shown in FIG. 4A. Or the seams 410, 430, and 440 may be spaced apart in a generally vertical orientation, diagonal orientation, zig-zag orientation, criss cross orientation, curvilinear orientation, or any other desired orientation. The spacing of seams 410, 430, and 440 may vary, as may the relative orientation of the seams 410, 430, and 440 and/or the shape of the seams 410, 430, and 440, enabling the baffles 405 and 407 to be different shapes and/or sizes.

Continuing, in some aspects, the seams 410, 430, and 440 may be spaced such that there is minimal space between the seams 410, 430, and 440 thereby resulting in smaller-sized baffles 405 and 407. In other aspects, the seams 410, 430, and 440 may be spaced more widely apart to create larger-sized baffles 405 and 407 with the ability to enclose more voided portions 420 of the layer of thermally insulating sheet material. In some exemplary aspects, spacing between the seams 410, 430, and 440 may be greater than the width of the seams 410, 430, and 440 (defined by first and second seam boundaries of each seam). In other exemplary aspects, spacing between the seams 410, 430, and 440 may be greater than twice the width of the seam 410, 430, and 440, and so on. Exemplary distances between adjacent seams 410, 430, and 440 may comprise, for example, between 1 cm and 20 cm, between 2 cm and 15 cm, and/or between 3 cm and 10 cm, although ranges above and below these values are contemplated herein. In aspects, the spacing between adjacent seams 410, 430, and 440 may be variable depending upon the desired amount of insulation needed at different portions of a garment. In other words, smaller baffles (seams are closer together) may be able to enclose a thinner, or a smaller section of thermally insulating sheet material when compared to a larger baffle (seams are further apart). Further, the seams 410, 430, and 440 may be linear, as shown, or alternatively, the seams 410, 430, and 440 may take on a non-linear, or in other words, a curvilinear configuration (not shown).

Further, as described above, the perforations 450 may form a pattern on the seams 410, 430, and 440. The seams 410, 430, and 440 may be perforated to form the one or more perforations 450 when the seams 410, 430, and 440 are being formed, or the perforations 450 may be created after the seams 410, 430, and 440 are formed. In exemplary aspects, one or more perforations 450 in the seams 410, 430, and 440 may be formed using, for instance, a laser, an ultrasonic cutter, a water-jet cutter, a mechanical cutter, and the like. Provided the proper equipment, the seams 410, 430, and 440 may be simultaneously formed and perforated in a single step to form the one or more perforations 450, although the seams 410, 430, and 440 and the one or more perforations 450 may be formed in separate steps without departing from the scope of the technology described herein. In other aspects, the one or more perforations 450 may be integrally formed in the seams 410, 430, and 440 during a knitting or a weaving process, as shown in FIG. 4C.

Figure 4B:
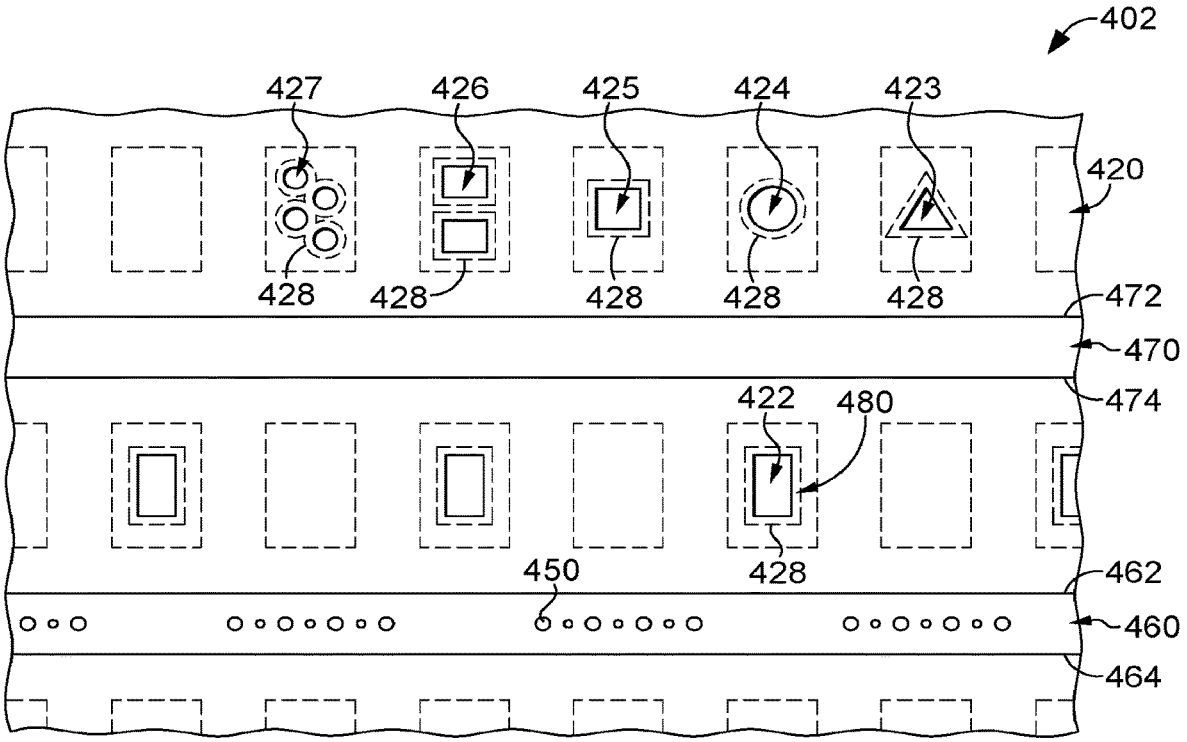
FIG. 4B is a partial view of an exemplary panel having a second configuration constructed in accordance with aspects herein.
Figure 4C:
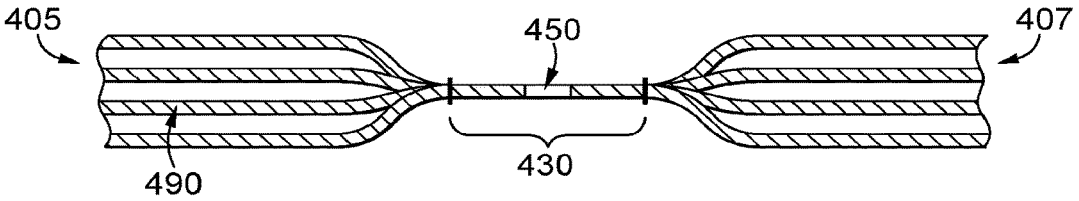
FIG. 4C is a cross sectional view of FIG. 4A along the line 4C-4C and depicts an integrally knit or woven construction in accordance with aspects herein.

With respect to FIG. 4C, which illustrates a cross sectional view of just the seam 430 in FIG. 4A, in one exemplary aspect, the seam 430 may be formed during a knitting or weaving process. For example, the knitting or weaving process may be modified to integrally knit or weave the seam 430 and the baffles 405 and 407. Moreover, this same knitting or weaving process may be used to integrally knit or weave the fill in the baffles 405 and 407 using, for example, float yarns 490, as shown (when weaving), or loops (not shown, when knitting) at the time they are created. Any and all aspects, and any variation thereof, are contemplated as being within the scope herein.

Moving on to FIG. 4B, an exemplary view of another partial panel 402 is shown. In accordance with this example, it is shown that one or more vent openings 422 may be formed at one or more affixed portions 480 aligned with one or more voided portions 420 in a thermally insulating sheet material. The one or more affixed portions 480 may be formed by affixing an interior surface of a first layer of pliable material to an interior surface of a second layer of pliable material. Each affixed portion 480 is delineated by a margin 428. The one or more vent openings 422 may be used instead of or in addition to the perforations 450 on the seams, as shown in seam 460 defined by first/upper seam boundary 462 and second/lower seam boundary 464.

In exemplary aspects, the one or more vent openings 422 may have a similar shape as the voided portion 420 in the thermally insulating sheet material, as shown, or may have a shape that is different than the voided portion 420, as shown in, for example, vent openings 423, 424, and 425. Alternatively, multiple vent openings may be formed at a single affixed portion 480 (delineated by margin 428), as shown for vent openings 426 and 427.

With reference to both FIGS. 4A and 4B, the perforations 450 and/or the vent openings 422, 423, 425, 426, and 427 may be configured to provide ventilation and moisture management by allowing moisture vapor from perspiration and/or heat to escape to the exterior environment. The location of the perforations 450 and/or the vent openings 422, 423, 425, 426, and 427 in the interior and exterior panels can vary in different aspects. For example, the perforations 450 may penetrate both panels in the seams 410, 430, 440, and 460 (e.g., penetrate the exterior panel, the adhesive (if used) and the interior panel within the seams 410, 430, 440, and 460). In another aspect, an additional interior panel may be provided, where the additional interior panel may or may not comprise openings or perforations. If openings or perforations are provided in the additional interior panel, the openings or perforations may or may not be offset from the perforations 450. In another example, in a two-panel garment (e.g., in a garment comprising just the exterior garment panel without the additional interior panel), the perforations 450 in the exterior panel in the seams 410, 430, 440, and 460 can be offset from openings in the interior panel at the seams 410, 430, 440, and 460, for example.

Figure 5B:
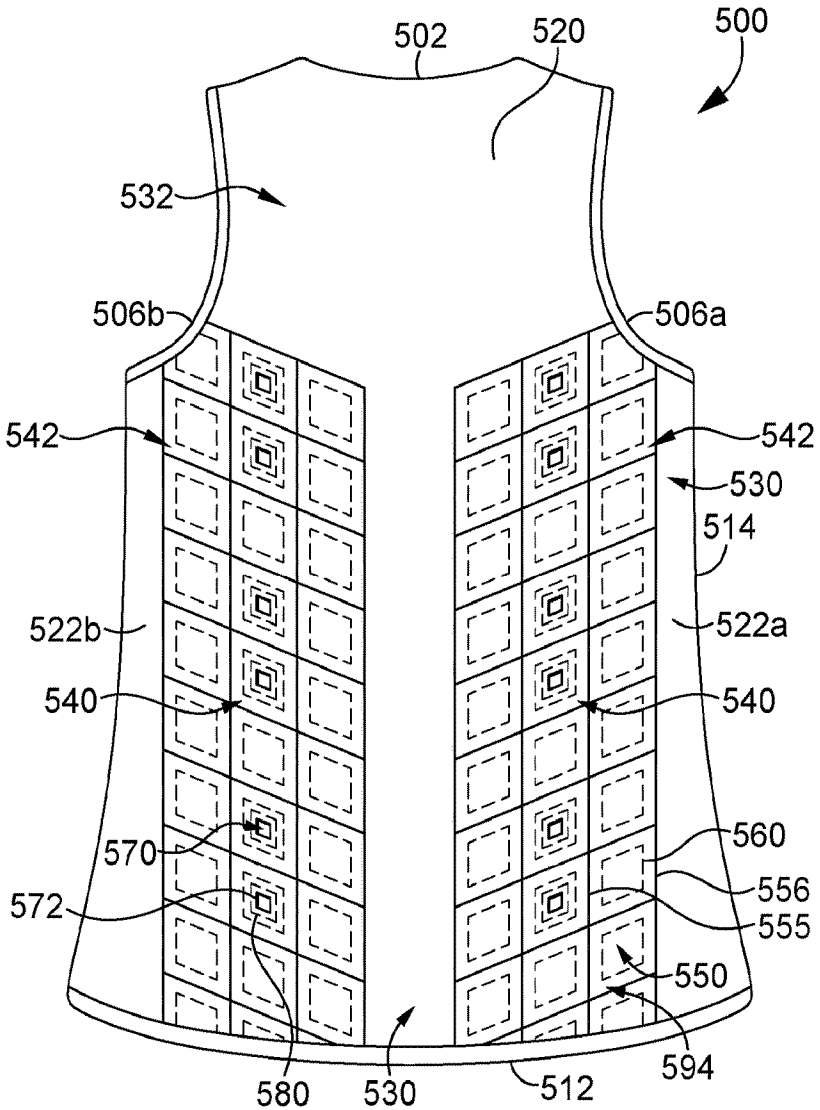
FIG. 5B is a back view of the exemplary garment shown in FIG. 5A in accordance with aspects herein.
Figure 5A:
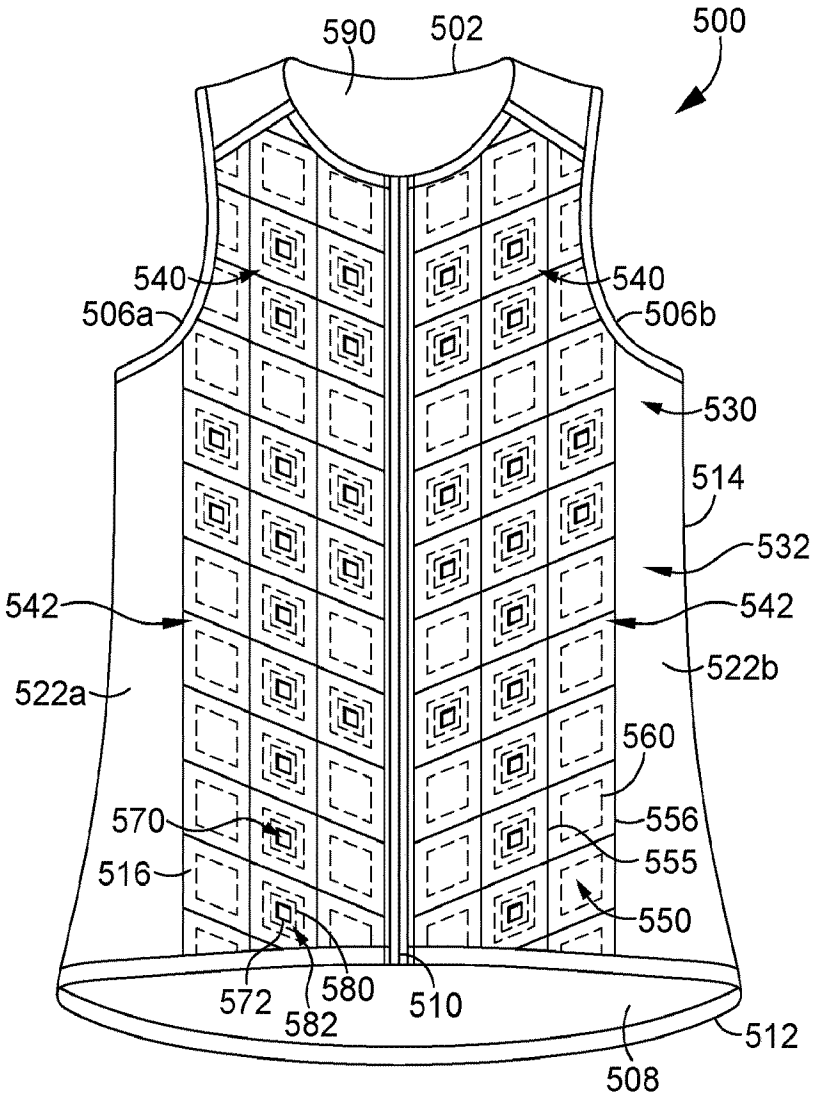
FIG. 5A is a front view of an exemplary garment constructed in accordance with aspects herein.

FIGS. 5A and 5B are front and back views, respectively, of an exemplary upper body garment 500 constructed in accordance with aspects of the technology described with reference to FIGS. 1A-4B. The upper body garment 500 is in the form of a vest configured to cover an upper torso area of a wearer when the garment is worn. With respect to FIGS. 5A and 5B, the upper body garment 500 may comprise a front panel 522*a* and a front panel 522*b*, adapted to cover a front torso area of a wearer when the upper body garment 500 is in as as-worn configuration. The front panels 522*a* and 522*b* may comprise a fastener 510 for releasably affixing the two front panels 522*a* and 522*b* together to close the upper body garment 500. The fastener 510 may be in the form of a zipper, snaps, buttons, hook-and-loop fasteners, or any other suitable means for releasably fastening the front panels 522*a* and 522*b*. Alternatively, front panels 522*a* and 522*b* may constitute a single front panel. The upper body garment 500 may further comprise at least one back panel 520 adapted to cover a back torso area of the wearer when the upper body garment 500 is in the as-worn configuration. The front panels 522*a* and 522*b*, and the at least one back panel 520 may be affixed at least at garment forming seams 514 to define in part at least a neckline opening 590 defined by a collar edge 502, a first armhole 506*a*, a second armhole 506*b*, and a waist opening 508 defined by waist edge 512. Alternatively, the front panels 522*a*, 522*b*, and the back panel 520 may be formed via a seamless construction such that the panels 522*a*, 522*b*, and 520 comprise integrally knit or woven extensions of each other without garment forming seams 514. Any and all aspects, and any variation thereof, are contemplated as being within aspects herein.

In accordance with aspects herein, each panel 522*a*, 522*b*, and 520 of, for example, upper body garment 500 may be formed to be an insulated garment panel comprising at least one layer of thermally insulating sheet material having one or more voided portions interposed or positioned between at least two layers of pliable sheet material in all panels 522*a*, 522*b*, and 520 of the garment 500 (in this configuration, the entire garment 500 will have the configuration of the garment areas 540 shown in FIGS. 5A and 5B). Or, in the alternative, the panels 522*a*, 522*b*, and 520 of the upper body garment 500 may have different garment areas 530 and 540, as shown in FIGS. 5A and 5B. In other words, the garment areas 530 may have a different configuration and different characteristics than the garment areas 540. For example, the upper body garment 500 shown in FIGS. 5A and 5B comprises four garment areas 540 surrounded by garment areas 530, where the garment areas 530 are shaped and sized to complement the areas of the garment 500 that are not covered by the garment areas 540.

Continuing, the garment areas 530 may comprise the same materials as the garment areas 540 minus the thermally insulating sheet material layer, i.e. having the interior and exterior pliable material garment layers extending throughout the panels 522*a*, 522*b*, and 520 through garment areas 530 with the thermally insulating sheet material layer only being present in garment areas 540.

Alternatively, the garment areas 530 may comprise the same materials as the garment areas 540 with the thermally insulating sheet material layer affixed to only the interior garment layer in the garment areas 530 (via tack points (adhesive or stitched) or stitching lines along portions of the interior garment layers aligning with non-voided portions 594 of the thermally insulating sheet material). Garment areas 540, on the other hand, may have the thermally insulating sheet material layer affixed to both the interior and the exterior garment layers, or affixed to just the exterior garment layer via seams 555 formed by, for example, stitching along portions of the internal and external garment layers that align with non-voided portions 594 of the thermally insulating sheet material. This configuration allows for the formation of a visual effect, minimizing the appearance of seams 555 formed by, for example, stitching, on the outer surface of the upper body garment 500.

Moreover, in yet another example of the upper body garment 500, the garment areas 530 may comprise a single layer of material, for example, the same material as the exterior garment layer, where the garment areas 540 and 530 may be part of the same exterior garment panel (seamless transition between garment areas 540 and 530). Alternatively, the garment areas 530 may comprise a single layer of material, for example, the same material as the interior garment layer, where the garment areas 540 and 530 may be part of the same interior garment panel (seamless transition between garment areas 540 and 530).

Furthermore, in yet another example of the upper body garment 500, the garment areas 530 may comprise one or more layers of different materials than the materials forming the garment areas 540. For example, garment areas 540 may comprise external and/or internal garment layers formed from, for example, an ultra-thin fabric/textile optionally treated with a DWR chemical treatment. Further, garment areas 540 may comprise a thermally insulating sheet material having one or more voided portions 550 interposed or positioned between the external and internal garment layers. The garment areas 530, on the other hand, may be formed of a breathable and elastic moisture management knit or woven textile, a mesh fabric, a cotton fabric, a terry fabric, or any other suitable fabric in accordance with aspects herein. In accordance with aspects herein, the garment areas 530 may be comprised of one or more breathable garment panels 532 and the garment areas 540 may be comprised of one or more insulated garment panels 542. In the example shown in FIGS. 5A and 5B, the upper body garment 500 comprises two front insulated panels 542 and two back insulated panels 542. The one or more breathable garment panels 532 of the garment areas 530 may be sewn or otherwise permanently affixed to the one or more insulated garment panels 542 of the garment areas 540 at seams 556, which may extend around the perimeter of each insulated garment panel 542. There, may be additional garment forming seams 514, where necessary, to form the upper body garment 500.

Alternatively, the breathable garment panels 532 may be integrally knit or woven with the insulated garment panels 542. Any and all aspects, and any variation thereof, are contemplated as being within aspects herein.

As described above, the garment areas 540 may comprise at least one interior layer and at least one exterior layer of pliable material with a layer of thermally insulating sheet material having a plurality of voided portions 550, interposed or positioned between the at least one interior layer and the at least one exterior layer of pliable material. The layer of thermally insulating sheet material in upper body garment 500 is secured to at least the exterior layer of pliable material (i.e. could be secured to both the interior and the exterior layers of pliable material) via a plurality of seams 555 formed at portions on the interior and exterior layers of pliable material corresponding to non-voided portions 594 in the layer of thermally insulating sheet material. The plurality of seams 555 cooperate with each other to form a plurality of baffles 516. Each baffle 516 in this example, encloses a corresponding voided portion 550 defined by a perimeter 560 in the layer of thermally insulating sheet material. Further, as shown, the upper body garment 500 comprises one or more of affixed portions 582 where the interior surface of the interior layer of pliable material is affixed to the interior surface of the exterior layer of pliable material in areas corresponding to one or more voided portions 550 in the thermally insulating material, each affixed portion 582 being defined by a perimeter 580. Each affixed portion 582 defined by a perimeter 580 may then be perforated or otherwise opened up or cut to accommodate vent openings 570, each vent opening 570 being defined by a perimeter 572. The vent openings 570 may be strategically placed throughout the upper body garment 500 at areas on the upper body garment 500 aligning with a wearer's body parts that produce the greatest amount of heat and perspiration for cooling (for example: armpits, upper back, lower back, chest, thighs, and the like). Depending on the type of garment and the amount of coverage offered by the particular garment, the vent openings 570 may be placed throughout a garment to add a visual effect by forming a pattern with the vent openings 570, in addition to providing ventilation to the garment.

Figure 6B:
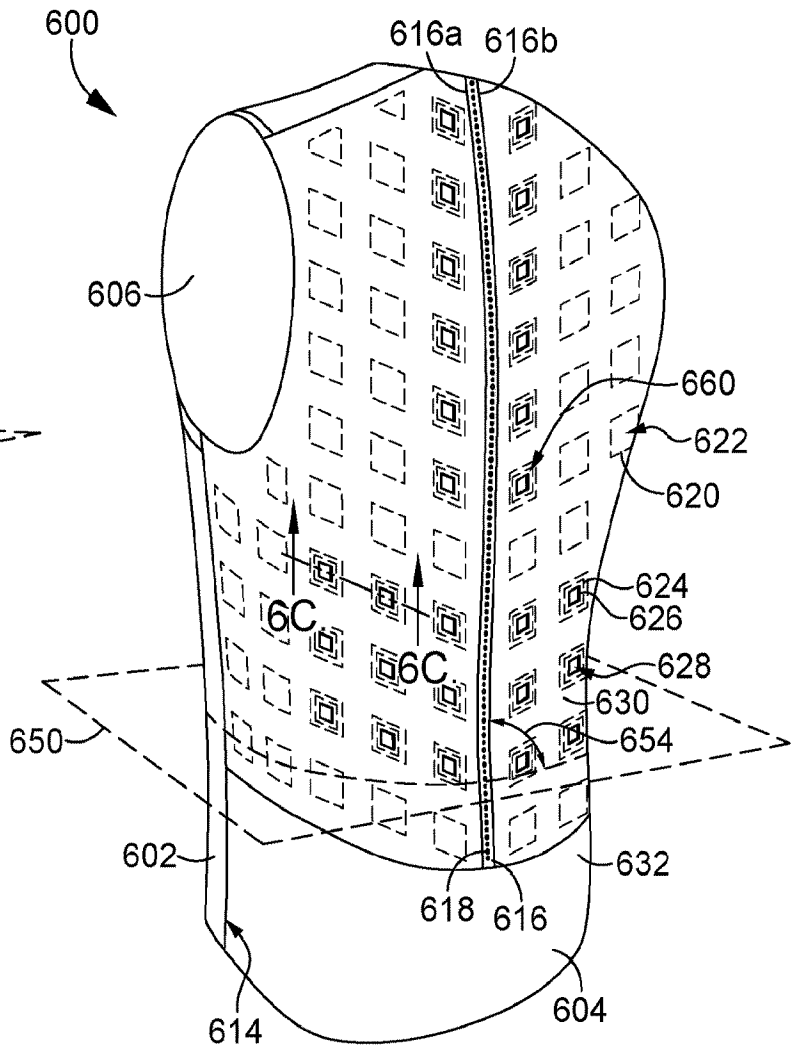
FIG. 6B is a back perspective view of the exemplary garment shown in FIG. 6A in accordance with aspects herein.
Figure 6A:
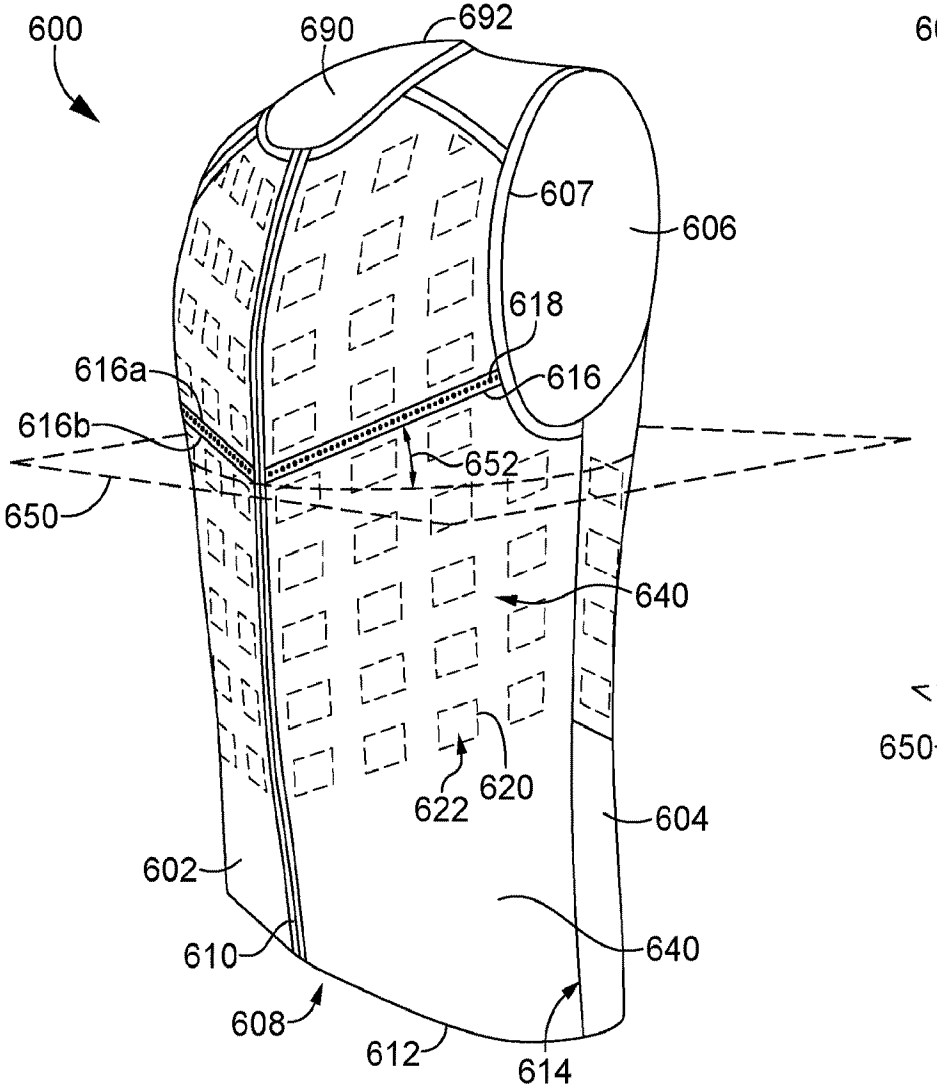
FIG. 6A is a front perspective view of an exemplary garment constructed in accordance with aspects herein.

FIGS. 6A and 6B are front and back perspective views respectively of another exemplary upper body garment 600 constructed in accordance with aspects herein. The upper body garment 600 is in the form of a vest configured to cover an upper torso area of a wearer when the garment 600 is worn. The upper body garment 600 may comprise at least one front panel 602 and at least one back panel 604. In the example shown in FIGS. 6A and 6B, the upper body garment 600 comprises two front panels 602, adapted to cover a front torso area of a wearer when the upper body garment 600 is in as as-worn configuration. The front panels 602 may comprise a fastener 610 for releasably affixing the two front panels 602. The fastener 610 may be in the form of a zipper, snaps, buttons, hook-and-loop fasteners, or any other suitable means for releasably fastening the front panels 602 to each other. Alternatively, front panels 602 may constitute a single front panel. The upper body garment 600 may further comprise at least one back panel 604 adapted to cover a back torso area of the wearer when the upper body garment 600 is in the as-worn configuration. The front panels 602, and the back panel 604 may be affixed at least at garment seams 614 to define, in part, at least a neckline opening 690 defined by a collar edge 692, armholes 606 defined by armhole edges 607, and a waist opening 608 defined by waist edge 612. Alternatively, the front panels 602 and the back panel 604 may comprise integrally knit or woven extensions of each other to form a seamless construction.

In accordance with aspects herein, each panel 602 and 604 of, for example, upper body garment 600 may be formed to be an insulated garment panel comprising at least one layer of thermally insulating sheet material having one or more voided portions 622 interposed or positioned between at least two layers of pliable sheet material in all panels 602 and 604 of the upper body garment 600. Alternatively, different types of materials may be combined to create a final garment having different characteristics at different areas of the upper body garment 600. For example, the back panel 604 may have a first area 630 and a second area 632, as shown in FIG. 6B. Further, upper body garment 600 may comprise seams 616 having a plurality of perforations 618.

Each of the seams 616 may have a first seam boundary 616*a* and a second seam boundary 616*b* that define the width of each seam 616. As shown in FIGS. 6A and 6B, the seams 616 can run along any desired direction, for example, the seams 616 on the front panels 602 are provided at an acute angle 652 from an imaginary horizontal plane 650 cutting across the front panels 602 and back panel 604 of the upper body garment 600, while seam 616 on the back panel 604 is provided at a right angle 654 from the imaginary horizontal plane 650 cutting across the front panels 602 and back panel 604. However, this is only an exemplary configuration for the seams 616. For example, although shown to be linear, seams 616 may be curvilinear, or may follow a particular desired design, such as for example letters, a logo, etc. As described above with reference to FIGS. 4A to 4C, these type of seams may be formed by sewing along the first seam boundary 616*a* and the second seam boundary 616*b* defining each seam 616, or alternatively, the seams 616 may be formed by adhering internal surfaces of both garment layers together using an adhesive tape having a particular width that will define the width of the seams 616, and/or, the seams 616 may be formed by fusing the garment layers together with or without an adhesive, depending on the type of material used for the garment layers.

Stitching along the first seam boundary 616*a* and the second seam boundary 616*b* of the seams 616 may be optional for reinforcement when the garment layers are adhesively bonded or fused together. If the seams 616 are only formed by stitching, the plurality of perforations 618 may extend straight through both garment layers at the seams 616, or a plurality of perforations on the interior garment layer (not shown) may be offset from the plurality of perforations 618 on the exterior garment layer. When the plurality of perforations on the interior garment layer are offset from the plurality of perforations 618 on the exterior garment layer, air or moisture may flow from the plurality of perforations on the interior garment layer through a passage formed between the interior and exterior garment layers at the seams 616, and out through the plurality of perforations 618 on the exterior garment layer. As well, cool air may enter the upper body garment 600 through the plurality of perforations 618 on the exterior garment layer, through the passage formed between the interior and exterior garment layers at the seams 616, and into the garment through the plurality of perforations on the interior garment layer. The plurality of perforations 618 may be formed in accordance to any configuration, for example, as described with respect to FIGS. 4A-4C.

The thermally insulating sheet material interposed or positioned between the interior and the exterior garment layers may be shaped according to the specifications of a particular garment panel to fit within a desired cavity/baffle formed by the interior and exterior garment layers in the panels 602 and 604. For example, as shown in FIGS. 6A and 6B, the panels 602 and 604 have a "smooth look" as opposed to a "quilted look" (shown in the upper body garment 500 in FIGS. 5A and 5B). This configuration, as shown in FIGS. 6A and 6B minimizes the appearance of seams or stitches on the outer surface of the upper body garment 600. This is because the thermally insulating sheet material in this example, is not secured to the external garment layers. Instead, the thermally insulating sheet material may either be secured through tack points or seams at portions on the internal garment layer that correspond with the non-voided portions 640 in the thermally insulating sheet material. Alternatively, depending on the level of stability of the thermally insulating sheet material, the thermally insulating sheet material may be used as part of a reinforcement construction as described above. In an additional exemplary aspect, the thermally insulating sheet material may be secured in place between the interior and exterior garment layers, only at the garment forming seams such as seam 614.

As shown, the thermally insulating sheet material may comprise the one or more voided portions 622 only in certain areas of the garment 600, and may be free from voided portions in other areas such as, non-voided portions 640 of the garment. For example, in the upper body garment 600, only the upper three-quarters of the upper body garment 600 comprises the one or more voided portions 622 in the thermally insulating sheet material. Alternatively, the upper body garment 600 may comprise different areas of the garment panels with different material constructions, such as, for example, areas 630 and 632 in the back panel 604. For instance, the garment areas 632 may comprise the same materials as the garment areas 630 minus the thermally insulating sheet material layer (i.e. having the interior and exterior pliable material garment layers extending throughout the garment in areas 632 with the thermally insulating sheet material layer only being present in garment areas 630). Moreover, in yet another aspect, the garment areas 632 may comprise different materials than the garment areas 630. For example, the garment areas 632 may be formed of a breathable and elastic moisture management knit or woven textile, a mesh fabric, a cotton fabric, a terry fabric, or any other suitable fabric in accordance with aspects herein.

As shown, the upper body garment 600 in this example, comprises four "baffles," each baffle enclosing a plurality of voided portions 622 defined by perimeters 620 in the layer of thermally insulating sheet material. Further, as shown, the upper body garment 600 comprises one or more affixed portions 660 in the back panel 604, where the interior surface of the interior garment layer is affixed to the interior surface of the exterior garment layer at areas corresponding to one or more voided portions 622 in the thermally insulating material, each affixed portion 660 being defined by perimeter 624. Each affixed portion 660 defined by a perimeter 624 may then be cut or otherwise manipulated to form vent openings 628, each vent opening 628 being defined by a perimeter 626. The vent openings 628 may be strategically placed throughout the upper body garment 600 at areas on the upper body garment 600 aligning with a wearer's body parts that produces the greatest amount of heat and perspiration for rapid cooling (for example: armpits, upper back, lower back, chest, thighs, and the like depending on the type of garment and the amount of coverage offered by the particular garment). Alternatively or additionally, the vent openings 628 may be placed throughout the upper body garment 600 to add a visual effect by forming a pattern with the vent openings 628. For example, the plurality of vent openings 628 in FIG. 6B form a downward pointing arrow, and at the same time, align with body areas of a wearer that tend to have the greatest moisture release in the form of perspiration.

Figure 6C:
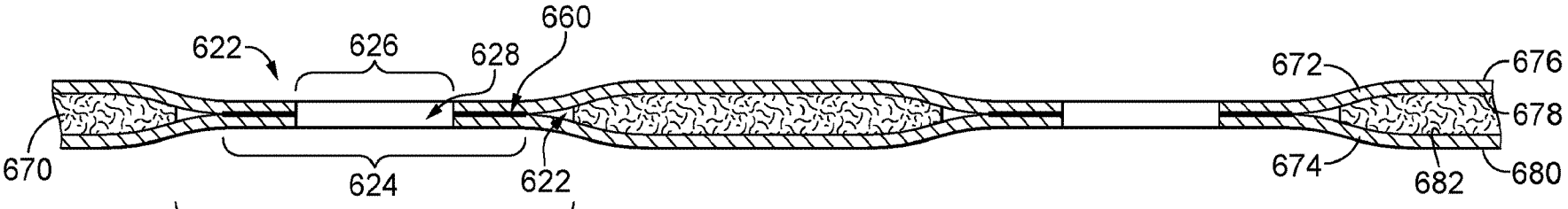
FIG. 6C is a cross-sectional view along the line 6B-6B in FIG. 6B in accordance with aspects herein.

FIG. 6C offers a closer look at the construction of the upper body garment 600. In particular, FIG. 6C depicts a cross-sectional view of the upper body garment 600 at a location corresponding to the vent openings 628 along the line 6C-6C in FIG. 6B. Although as shown, the garment construction comprises a first layer 672, a second layer 674, and a thermally insulating sheet material 670 interposed or positioned between the first layer 672 and the second layer 674, it is contemplated that the garment 600 may comprise more layers than explicitly described herein. The first layer 672 comprises an outer surface 676 and an inner surface 678. Similarly, the second layer 674 comprises an outer surface 680 and an inner surface 682. As shown, the inner surfaces 678 and 682 are adjacent to the thermally insulating sheet material 670, while the outer surfaces 676 and 680 are either exposed to the external environment, or a wearer's body, depending on which of the first layer 672 or the second layer 674, is configured to be the exterior garment layer or the interior garment layer, especially since the garment 600 may be constructed as a reversible garment having two different looks (e.g. different color, or different stitched configuration, and the like, on either surface).

As seen in FIG. 6C, and as discussed above, the upper body garment 600 comprises one or more of affixed portions 660 defined by perimeter 624, where the inner surface 678 of the first layer 672 is affixed to the inner surface 682 of the second layer 674 in areas corresponding to one or more voided portions 622 defined by perimeter 620 in the thermally insulating sheet material 670. Each affixed portion 660 defined by perimeter 624 may then be perforated or otherwise manipulated to form vent openings 628, each vent opening 628 being defined by a perimeter 626. In this example, the shape of each vent opening 628 substantially corresponds to the shape of the voided portion 622 of the thermally insulating sheet material 670. However, as discussed above with reference to FIG. 4B, the shape of the vent openings 628 may be different than the shape of the voided portion 622 of the thermally insulating sheet material 670.

FIG. 7 is a front view of an exemplary garment 700 constructed in accordance with aspects herein. Garment 700 illustrates the numerous possibilities for the configuration of the voided portions in the thermally insulating sheet material for use in garment construction, in accordance with aspects herein. Garment 700 is illustrated as an upper body garment having generally a first sleeve 710, a second sleeve 712, a first front panel 750, a second front panel 752, and a back panel (not shown), which in cooperation, form at least in part, a neck opening 756 and a waist opening 758. The first front panel 750 and the second front panel 752 may be releasably affixed to each other by a fastener 754, which may be in the form of a zipper (as shown), snaps, buttons, hook-and-loop fasteners, and the like, suitable for releasably affixing front panels 750 and 752, or alternatively, front panels 750 and 752 may be a single front panel.

Sleeve 710 of garment 700 illustrates an exemplary configuration for the voided portions 720 shown by the dashed lines 722 in the thermally insulating sheet material. As shown, the voided portions 720 may comprise any shape and size. In this particular example, the voided portions 720 comprise a curvilinear organic shape. The thermally insulating sheet material may be secured to the outer garment layer, the inner garment layer, or both the inner and the outer garment layers. For example, the thermally insulating sheet material may be secured to the outer garment layer or both the outer and inner garment layers through one or more tack points or stitches 730 to minimize the appearance of stitching, as shown. However, the tack stitches or points 730 may have also been made to secure the thermally insulating sheet material to only the inner garment layer, as is the case for seams 740 shown by dashed lines to indicate that the seams 740 are located interior to the outer garment layer. The seams 740 may be formed by any suitable means such as stitching, adhesive bonding, and the like.

Moving on to front panel 750, front panel 750 illustrates a different exemplary configuration for the plurality of voided portions 724 shown by dashed lines 726 in the thermally insulating sheet material in accordance with aspects herein. As seen in front panel 750, the plurality of voided portions 724 may comprise different sizes at different locations of the garment 700. In the particular example shown, the plurality of voided portions 724 comprise a curvilinear shape that forms a gradient 760 with the largest voided portion 724 starting at the middle and becoming increasingly smaller at the superior and inferior portions of the garment 700 with respect to the garment 700 being in an as-worn configuration. In addition to offering insulation, this type of configuration for the plurality of voided portions 724 may add a visual appeal to the garment 700 when at least the outer garment layer is made to be transparent or translucent, thereby allowing the viewing of the voided portions 724 in the thermally insulating sheet material. Additionally, in order to reduce the appearance of seams, the thermally insulating sheet material may be secured to the inner and/or outer garment layers only at the garment forming seams.

Turning to front panel 752, front panel 752 shows yet another exemplary configuration for the plurality of voided portions 729 in the thermally insulating sheet material shown by dashed lines 728. As shown in the front panel 752, a gradient in size 762 of the voided portions 729 may be created, where the voided portions 729 comprise geometric shapes in the form of squares or rectangles. Further, as illustrated by the gradient in size 762, the size of the plurality of voided portions 729 may be varied according to particular specifications for the garment 700 such as, for example, the level of insulation desired, the visual effects desired, and the like. Thus, garment 700 illustrates a few of the numerous possibilities for garment configurations in accordance with aspects herein. Additionally, although not explicitly shown here, one or more vent openings may be optionally provided at locations on the garment 700 corresponding to one or more voided portions 720, 724, or 729 to provide ventilation by aiding in air circulation in and out of the garment 700.

Figure 8:
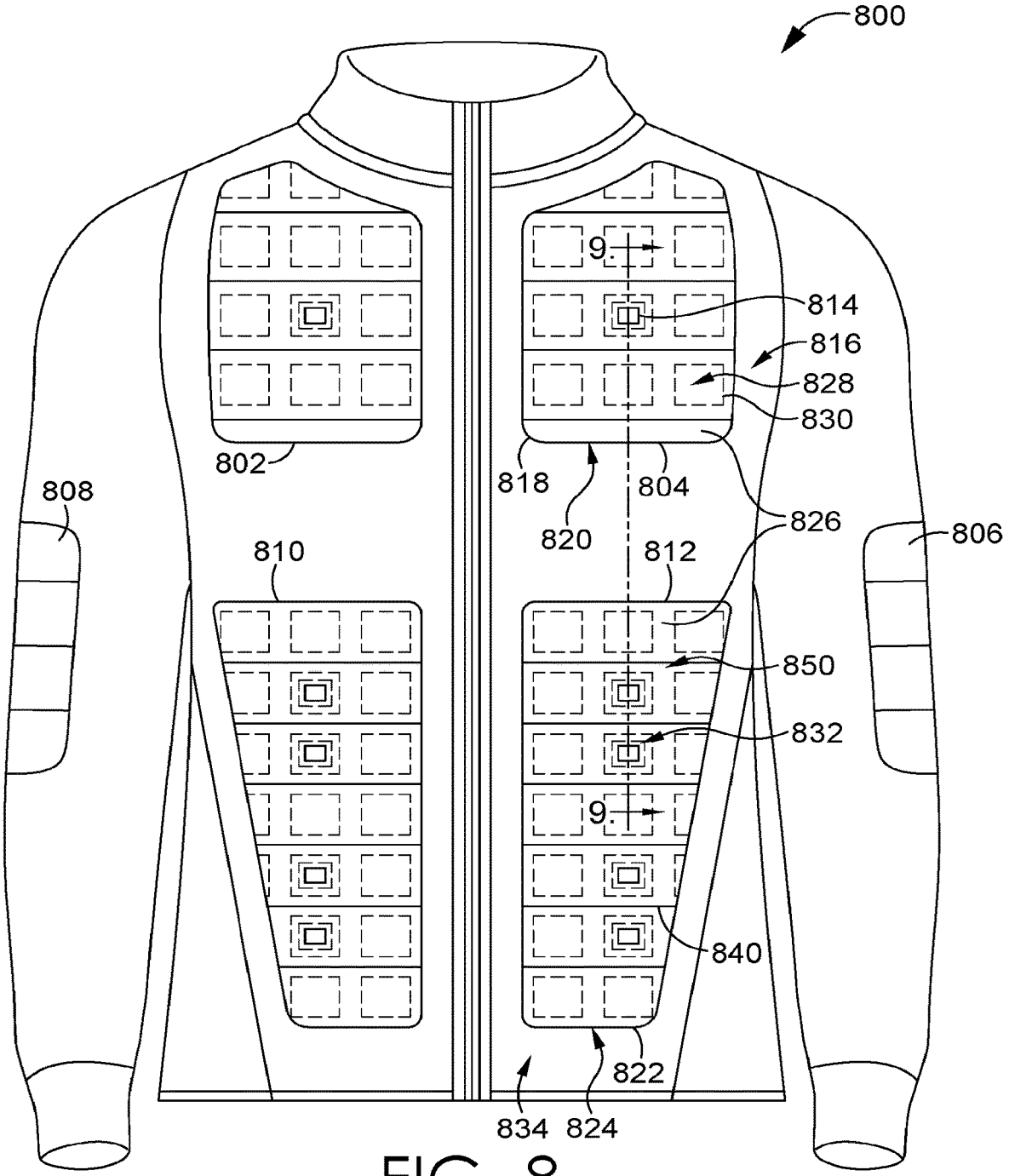
FIG. 8 is a front view of an additional exemplary garment constructed in accordance with aspects herein.

FIG. 8 illustrates yet another exemplary garment 800 in accordance with aspects herein. For instance, instead of providing insulation throughout the entire garment 800, it may be desirable to provide insulation only at discrete areas of the garment 800 as shown by different insulation sections 802, 804, 806, 808, 810, and 812. This may help to reduce bulkiness and/or may help to vary the level of insulation at different areas of the garment 800. Moreover, the level of insulation may be adjusted by increasing or decreasing the amount/thickness of the thermally insulating sheet material for one or more of the insulation sections 802, 804, 806, 808, 810, and 812. In exemplary aspects, the insulation sections 802, 804, 806, 808, 810, and 812 may be "pod" structures (as opposed to garment panels) constructed as described above (with reference to the garment panels). The "pod" structure may comprise a voided thermally insulating sheet material (918/920 shown in FIG. 9) interposed and placed between two layers of pliable material (902 and 908 shown in FIG. 9). The thermally insulating sheet material (918/920) can be secured to one or both of the layers of pliable material (902 and 908) via one or more seams 840 at locations on the layers of pliable material (902 and 908) corresponding to non-voided portions 850 in the thermally insulating sheet material (918/920). Optionally, the insulation sections 802, 804, 806, 808, 810, and 812 may comprise one or more affixed portions 832 where one or more vent openings 814 may be provided for venting (breathability).

FIG. 8 in particular shows a garment 800 with a right-chest insulation section 802, a left-chest insulation section 804, a left-arm insulation section 806, a right-arm insulation section 808, a right-front torso insulation section 810, and a left-front torso insulation section 812. The insulation sections 802, 804, 810, and 812 comprise one or more vent openings 814, making the insulation sections 802, 804, 810, and 812 vented-insulation sections 802, 804, 810, and 812. Whether vented or not, the insulation sections 802, 804, 806, 808, 810, and 812 may be localized to maximize the retention of heat while still allowing the garment to remain lightweight with minimal bulkiness. For example, the insulation sections 802, 804, 806, 808, 810, and 812 may be located to align with areas of the body of a wearer that are more sensitive to temperature changes such as the chest region, thighs, and the like. The insulation sections 802, 804, 806, 808, 810, and 812 may also be located based on the comfort of the wearer when, for example, exercising, regardless of whether the insulation sections 802, 804, 806, 808, 810, and 812 are vented or not vented. Furthermore, the use of insulation sections 802, 804, 806, 808, 810, and 812 in a garment, such as garment 800, allows the present technology to be very versatile. As described above, the insulation sections 802, 804, 806, 808, 810, and 812 allow the provision of different levels of insulation at different locations on the garment 800 thereby providing different levels of protection to different body parts of a wearer. For example, in cold windy conditions, the most prominently exposed area of a wearer may be the chest area of a wearer. As such, a thicker insulating sheet material may be provided within right-chest and left-chest insulations sections 802 and 804 when compared to insulation sections 806, 808, 810, and 812.

The insulation sections 802, 804, 806, 808, 810, and 812 can be installed within the garment 800 by, for instance, cutting out portions of the garment 800 and inserting the insulation sections 802, 804, 806, 808, 810, and 812 in place of the cutout areas, or the insulation sections 802, 804, 806, 808, 810, and 812 may be placed adjacent to and joined to an outer surface of the garment 800. This will become more apparent in the cross-sectional view 900 along the line 9-9 of the left garment panel 816 of garment 800, as shown in FIG. 9.

Figure 9:
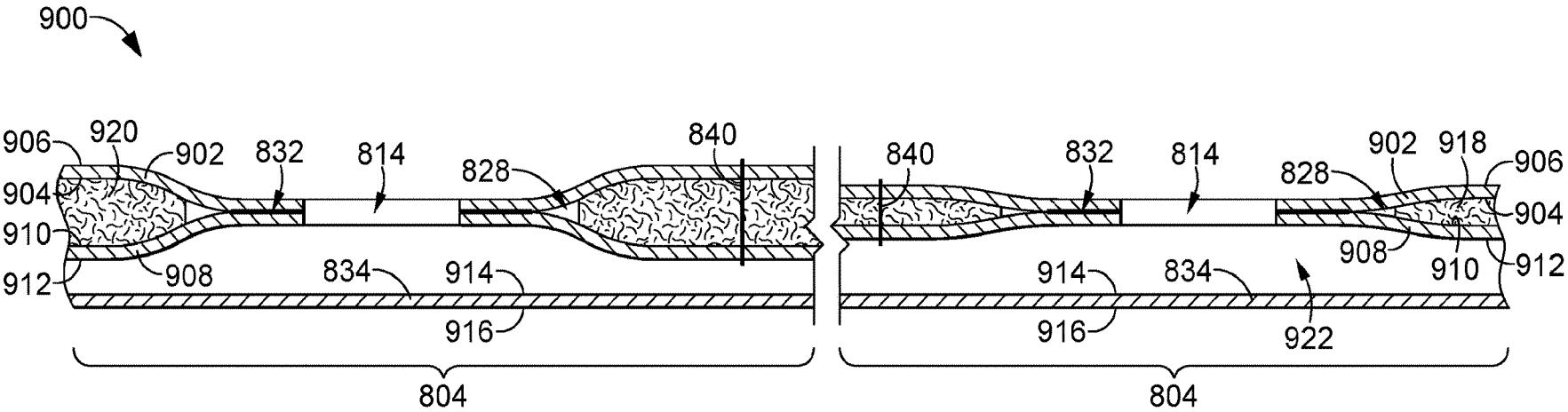
FIG. 9 is a cross-sectional view along the line 9-9 in FIG. 8 in accordance with aspects herein.

Turning now to FIG. 9, a cross-sectional view 900 of the left garment panel 816 through insulation sections 804 and 812 is provided. With respect to both FIGS. 8 and 9, the insulation sections 804 may be joined to an outer surface 914 of garment base layer 834 at seam 818 around a perimeter 820 of the insulation section 804. The insulation section 812, similar to insulation section 804, may be joined to the outer surface 914 of garment base layer 834 at seam 822 around a perimeter 824 of the insulation section 812. Each of the insulation sections 804 and 812 in the exemplary garment 800, comprises a plurality of baffles 826 defined/separated by seams 840, each baffle 826 enclosing respective voided portions 828 shown by dashed lines 830 in the thermally insulating sheet material 918/920. As described in the different examples above, the baffles 826 may be formed by securing the thermally insulating sheet material 918/920 to at least one of the first layer of pliable material 902 and the second layer of pliable material 908 at portions on the insulation sections 804 and 812 corresponding to non-voided portions 850 in the thermally insulating sheet material 918/920 by seams 840 (which may be formed by stitching, bonding, welding, fusing, and the like).

Continuing, one or more affixed portions 832 may be formed at different locations on the insulation sections 804 and 812 by joining (using an adhesive, fusing, welding, and the like) an interior surface 904 of the first layer 902 to an interior surface 910 of the second layer of pliable material 908 at areas on the first layer 902 and second layer 908 of pliable material aligning with a corresponding voided portion 828 in the thermally insulating sheet material 918/920. Each affixed portion 832 in the insulation sections 804 and 812 further comprises a vent opening 814 that extends through the first layer 902 and the second layer 908 of pliable material. The vent openings 814 allow heat and moisture that may buildup underneath the insulation sections 804 and 812 when the garment 800 is worn, to escape into the environment external to the garment 800. Additionally, the vent openings 814 may allow cooler air from the external environment to enter an environment internal to the garment 800 to regulate the internal temperature and prevent overheating especially, as the level of physical exertion of a wearer increases with exercise intensity and/or time.

As exemplified in FIG. 9, the insulation sections 802, 804, 806, 808, 810, and 812 may be joined or "installed" onto the garment base layer 834. When the insulation sections 802, 804, 806, 808, 810, and 812 are joined to the garment base layer 834, a void or space 922 is formed between the outer surface 912 of the second layer of pliable material 908 and the outer surface 914 of the garment base layer 834. The space 922 may function as a passage for transmission of moisture vapor and/or air through the garment 800. In exemplary aspects, the garment base layer 834 may be formed from a mesh material, or a material having moisture-wicking or moisture-management properties. Using a mesh material or a material having moisture-wicking or moisture-management properties as the garment base layer 834 may increase wearer comfort.

Furthermore, the garment base layer 834 may comprises a plurality of interior perforations or openings (not shown). The plurality of interior openings may not directly communicate with the external environment in contrast to the vent openings 814 on the affixed portions 832 of the insulation sections 802, 804, 810, and 812. The plurality of interior openings on the garment base layer 834 may be configured such that the plurality of interior openings are offset from the vent openings 814 on the insulation sections 802, 804, 810, and 812. In other words, there is not a direct communication path between the vent openings 814 and the plurality of interior openings. To put it another way, the route that moisture vapor and/or air would traverse when traveling through the garment 800 is not direct (straight), namely: the moisture vapor and/or air would traverse 1) from the wearer's body, 2) through the plurality of interior openings, 3)

into the space 922, and 4) out the vent openings 814 where the moisture vapor may be discharged into the external environment.

The plurality of interior openings in the garment base layer 834 may be distributed throughout the garment base layer 834 and/or may be localized in certain areas such as only underneath the insulations sections 802, 804, 810, and 812, depending on the level of ventilation and/or breathability needed for the garment 800. In one exemplary aspect, the plurality of interior openings on the garment base layer 834 may be configured to overlap with the vent openings 814. In another exemplary aspect, the plurality of interior openings on the garment base layer 834 may be configured to not overlap with the vent openings 814 associated with the insulation sections 802, 804, 810, and 812 at all. In another exemplary aspect, the distribution of the plurality of interior openings on the garment base layer 834 may be configured such that a majority of the plurality of interior openings (e.g., greater than 50%, 70%, 80%, or 90%) do not overlap with the vent openings 814.

The size and number of the vent openings 814 on the insulation sections 802, 804, 810, and 812, and/or the plurality of interior openings (not shown), may be adjusted to provide different ventilation and breathability characteristics, while still maintaining the structural integrity of the fabric and the thermally insulating sheet material 918/920. For instance, a larger size and/or greater number of vent openings 814 in portions of the garment 800 may provide a higher degree of ventilation and breathability characteristics to these portions. In another example, a smaller size and/or a fewer number of vent openings 814 in other portions of the garment 800 may provide for a lower degree of ventilation and breathability characteristics. Thus, by adjusting the size and/or number of the vent openings 814, different ventilation and breathability characteristics may be imparted to different portions of the garment 800. In exemplary aspects, the width size of each individual vent opening 814 may range anywhere from 0.1 mm to 20 mm, between 0.1 mm and 15 mm, between 1 mm and 10 mm, between 2 mm and 5 mm, and the like. Other sizes of vent openings 814 may be used without departing from the scope of the technology described herein.

Furthermore, as briefly described above, the level of insulation may be adjusted by providing more or less insulation in the different insulation sections 802, 804, 806, 808, 810, and 812. For instance, as seen in FIG. 9, the thermally insulating sheet material 920 in insulation section 804 is thicker than the thermally insulating sheet material 918 in insulation section 812. This may result in a higher level of thermal insulation being provided by insulation section 804 at the chest area of the garment 800 than the insulation section 812 below the chest area of a wearer because the chest area of a wearer tends to have an initial exposure to the environmental conditions such as wind and cold temperature because of its prominence.

Figure 10:
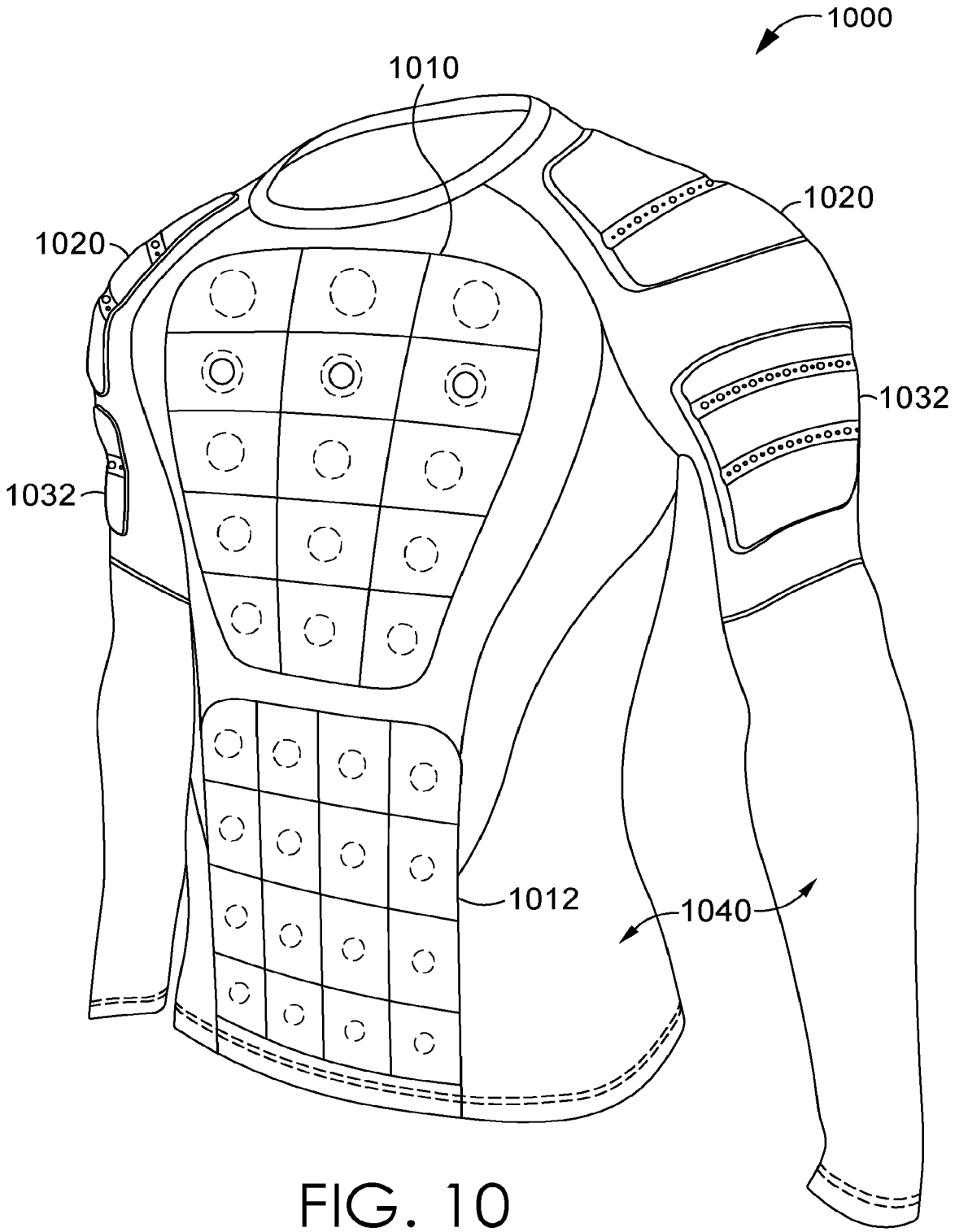
FIG. 10 is a front perspective view of an exemplary top garment with insulation sections in accordance with aspects herein.
Figure 11:
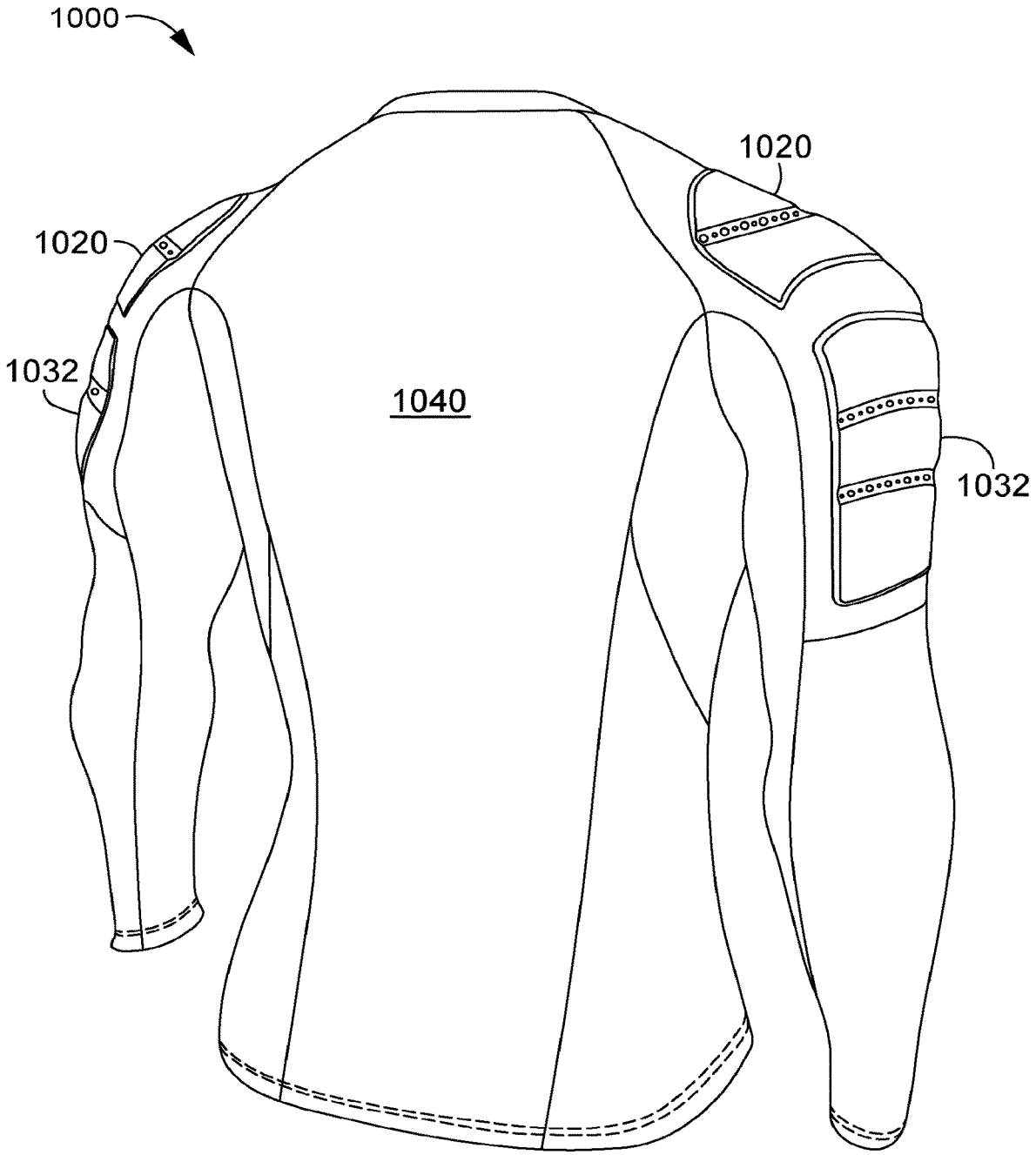
FIG. 11 is a back perspective view of the exemplary top garment with insulation sections in FIG. 10 in accordance with aspects herein.

Turning now to FIGS. 10-14, a number of exemplary configurations of insulation sections are depicted on different garments in accordance with aspects herein. The insulation sections have a configuration similar to that shown in, for example, FIGS. 5A-FIG. 9. FIG. 10, for instance, depicts insulation sections 1010, 1012, 1020, and 1032 within an athletic top 1000 in accordance with an aspect of the technology described herein. As shown in the perspective view of FIG. 10, the athletic top 1000 comprises a chest insulation section 1010 and a torso insulation section 1012, right and left-shoulder insulation sections 1020, and upper right and left-arm insulation sections 1032. FIG. 11 depicts a back perspective view of the athletic top 1000 and illustrates more clearly the right-shoulder insulation section 1020 and the upper right-arm insulation section 1032. The garment base layer 1040 may, in exemplary aspects, be constructed from a mesh material, a material having moisture-wicking or moisture-management properties, or a combination of both. Additionally, the garment base layer 1040 may be constructed from an elastic material that is moldable to a wearer's body. Additional materials are contemplated herein for the garment base layer 1040.

The construction of a garment, for example, as shown in garment 1000, will increase comfort for a wearer as the need for layering multiple garments together may be eliminated by providing thermal insulation to only those areas in the garment configured to cover thermally sensitive or most exposed areas of the wearer's body that would benefit from having a thermally protective layer. Another advantage of a garment construction with zonal thermal insulation such as garment 1000 is that there is no bulkiness impeding motion (as in conventional thermally insulated garments) and therefore, the wearer is afforded to have greater range of motion.

Figure 12:
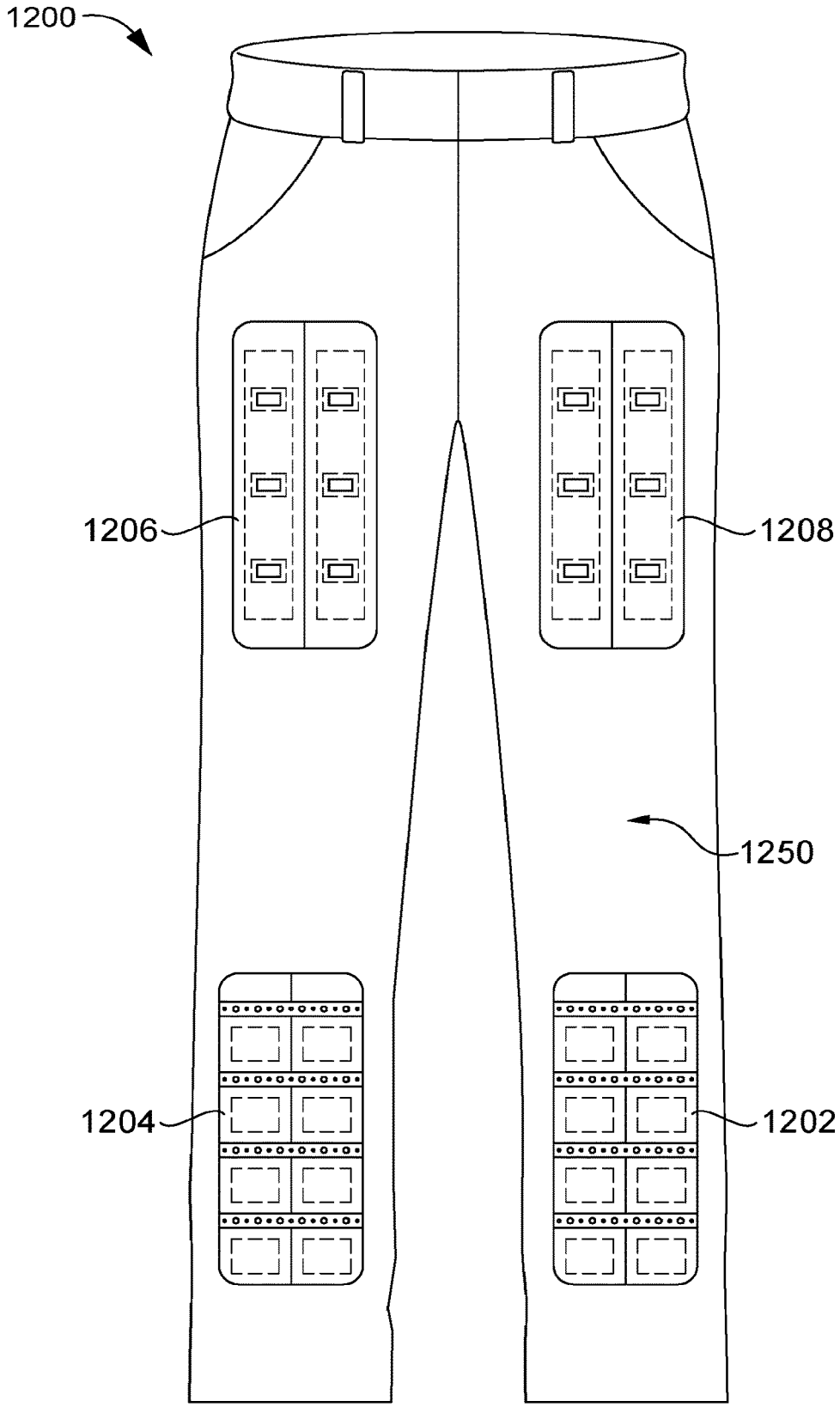
FIG. 12 is a front view of exemplary pants with insulation sections in accordance with aspects herein.
Figure 13:
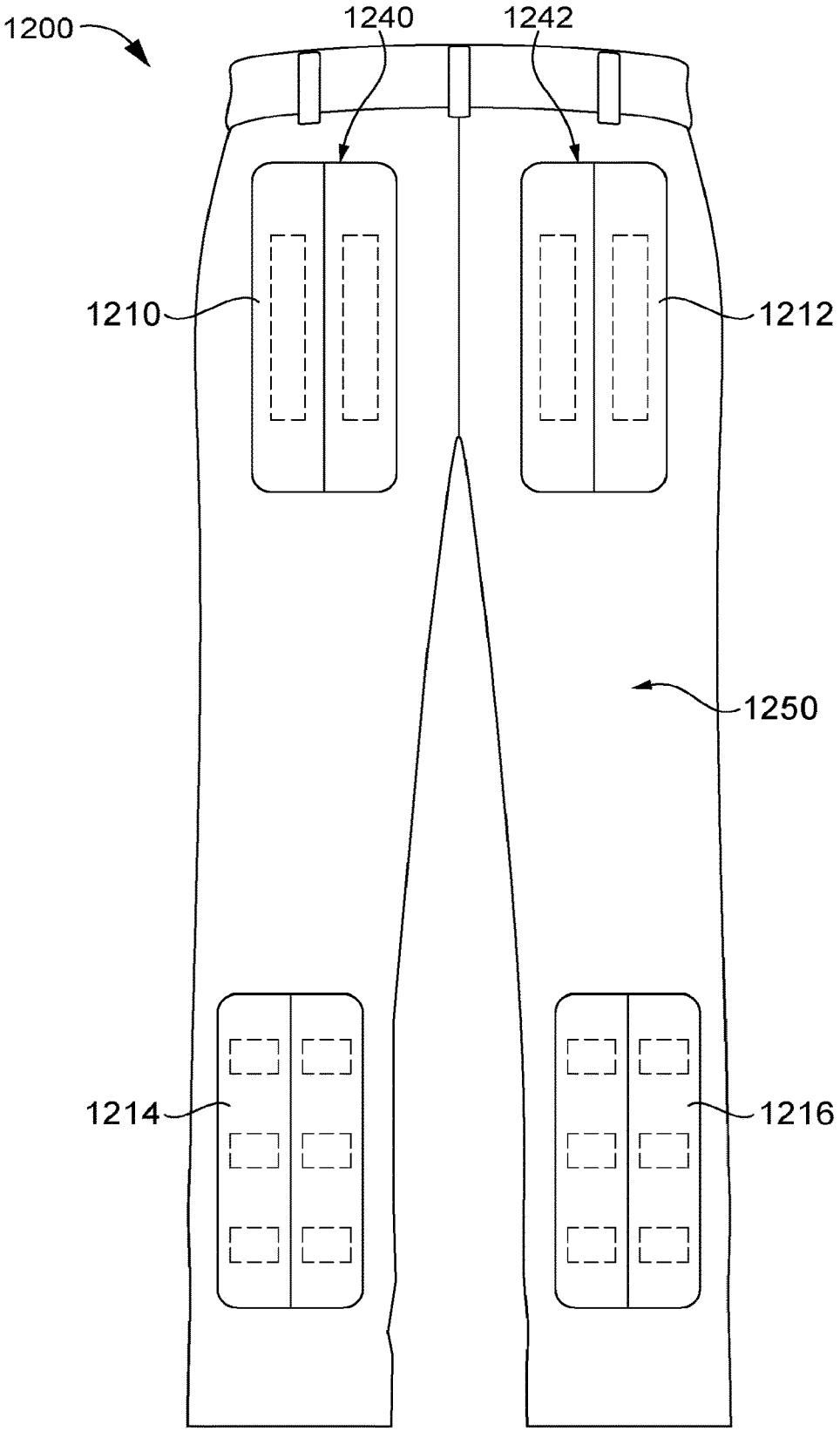
FIG. 13 is a back view of the exemplary pants with insulation sections in FIG. 12 in accordance with aspects herein.

Moving on to FIG. 12, FIG. 12 depicts a garment with zonal insulation such as pants 1200. The insulation section 1204 and the insulation section 1202 are located in the shin areas, the insulation section 1206 and the insulation section 1208 are located in thigh areas, and as shown in FIG. 13 which is a back view of pants 1200, the insulation sections 1210 and 1212 are located at a buttocks area. In some aspects, at least insulation sections 1210 and 1212 may have a double function as pant back pockets and as insulation sections, for example, by leaving the top edges 1240 and 1242 of the insulation sections 1210 and 1212, respectively, open or not sealed to the base layer 1250 forming the body of the pants 1200. Finally, insulation zones 1214 and 1216 are located in calf areas.

Aspects are not limited to these locations or functions. For example, the insulation sections 1202, 1204, 1206, 1208, 1210, 1212, 1214, and 1216 may be located in other desired/suitable locations within the pants 1200. Further, as shown, the insulation sections 1202, 1204, 1206, 1208, 1210, 1212, 1214, and 1216 may comprise different configurations, further allowing for the customization of the thermal function and the aesthetic appeal of the pants 1200 by customizing the different insulations sections 1202, 1204, 1206, 1208, 1210, 1212, 1214, and 1216 used throughout the pants 1200.

Figure 14:
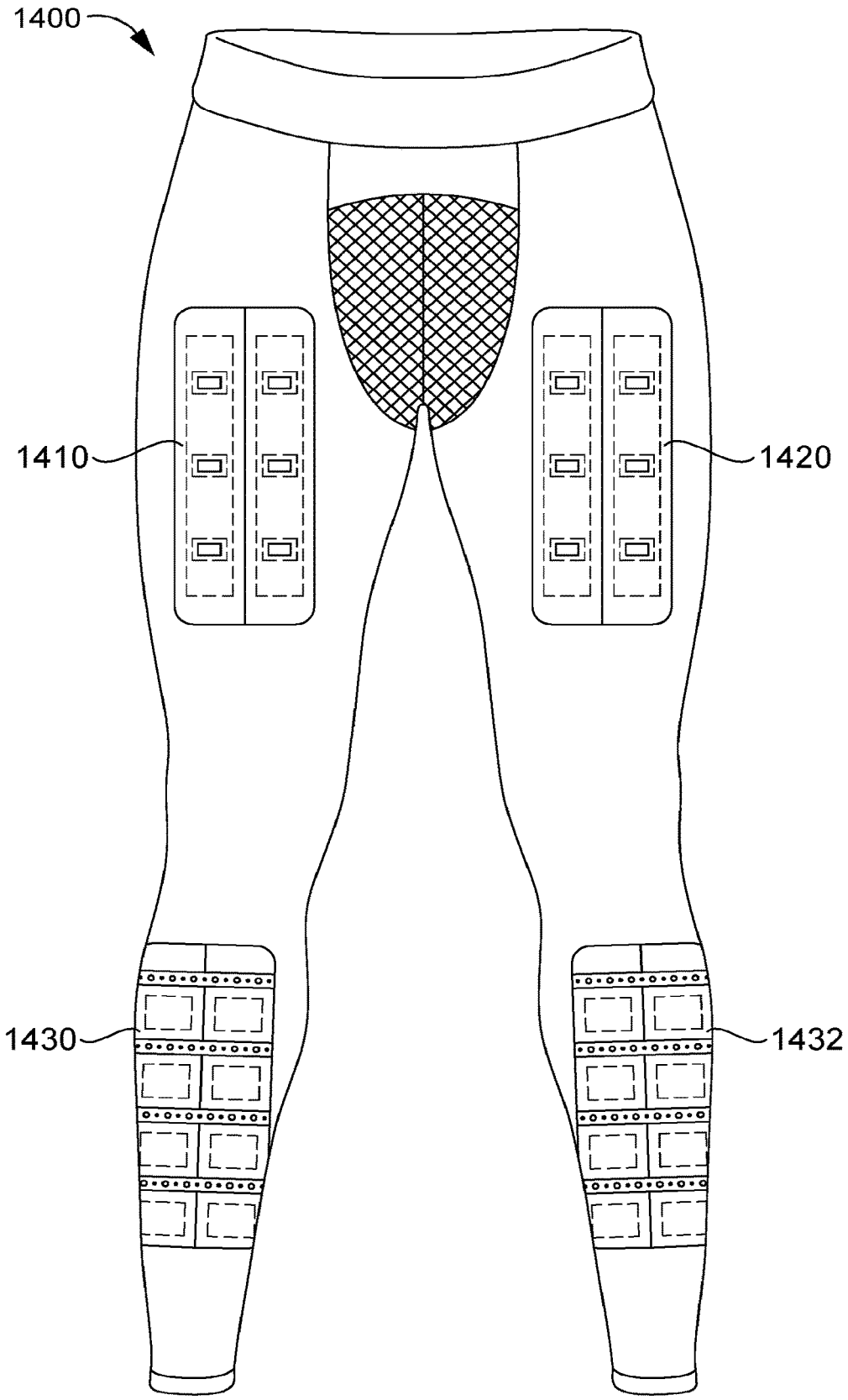
FIG. 14 is a perspective view of exemplary form fitting pants with insulation sections in accordance with aspects herein.

Turning now to FIG. 14, compression pants 1400 with zonal insulation in accordance with an aspect herein are shown. The compression pants 1400 are another example of garments that are configured to conform to a wearer's body when worn. The pants 1400 comprise a right-thigh insulation section 1410 and a left-thigh insulation section 1420. The compression pants 1400 additionally comprise a right-shin insulation section 1430 and a left-shin insulation section 1432. However, in a different exemplary garment, the compression pants 1400 may comprise just the right-thigh insulation section 1410 and the left-thigh insulation section 1420, depending on the specific construction desired for a specific level of insulation/protection desired.

Figure 15:
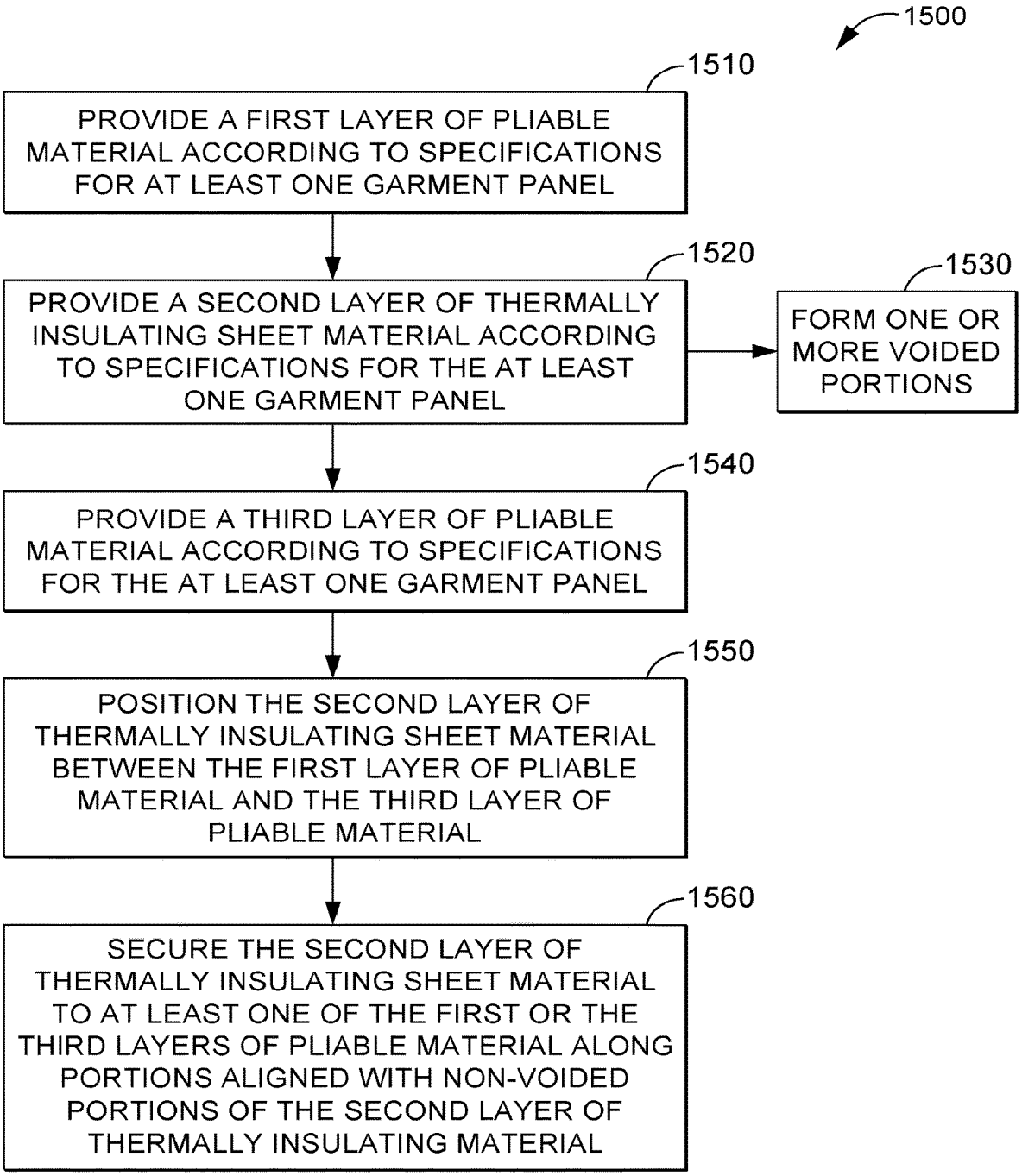
FIG. 15 is a flow chart illustrating an exemplary method of making a garment in accordance with aspects herein.

Turning now to FIG. 15, a flow chart showing an exemplary method 1500 of making a garment in accordance with aspects herein is provided. As described above, and as illustrated in the figures, garments in accordance with aspects herein may comprise a jacket, a vest, pants, full body suit, and the like and may comprise any of the configurations as described herein. At step 1510, a first layer of pliable material according to specifications for at least one garment panel (or insulation section) may be provided. At step 1520, a second layer of thermally insulating sheet material according to specifications for the at least one garment panel (or insulation section) may be provided. If the second layer of thermally insulating sheet material does not comprise one or more voided portions, one or more voided portions may be formed on the second layer of thermally insulating material at step 1530 by, for example, laser cutting, die cutting, manual cutting, ultrasonic cutting, or any other suitable method according to predetermined specifications. Alternatively, the second layer of thermally insulating sheet material may be pre-formed having one or more voided portions according to the predetermined specifications. At step 1540, a third layer of pliable material may be provided according to specifications for the at least one garment panel (or insulation section). At step 1550, the second layer of thermally insulating sheet material may be interposed or positioned between the first layer of pliable material and the third layer of pliable material, and, at step 1560, the second layer of thermally insulating sheet material may be secured to at least one of the first and/or the third layers of pliable material at one or more portions of the first and/or the third layers of pliable material that are aligned with non-voided portions of the second layer of thermally insulating material. In an aspect, this process is repeated for each section of the garment or for each insulation section of the garment which, once completed at step 1560, are utilized to form the final garment.

In one aspect, one or more portions of the insulated garment may be constructed using an engineered weaving or knitting process (e.g., program a weaving or knitting machine to form these structures). For example, the exterior panels and the interior panels may be formed together through the knitting and weaving process, where the knitting or weaving process may be used to form the seams and/or the exterior and interior openings.

Optionally, if venting is desired for the garments in accordance with aspects herein, one or more vent openings may be formed by bonding a first portion of an interior surface of the first layer of pliable material and a corresponding second portion of an interior surface of the third layer of pliable material that are in alignment with at least one voided portion in the one or more voided portions of the second layer of thermally insulating sheet material to form at least one affixed portion. Then, one or more vent openings may be formed at the affixed portion that extend through all layers of the affixed portion. Alternatively, the ventilation may be provided at one or more seams separating one or more baffles of a garment/pod constructed in accordance with aspects herein. The one or more seams separating the one or more baffles may comprise a width defined by seam boundaries/edges for each of the one or more seams. The one or more seams may be formed in a similar manner as the affixed portions described above, where an interior surface of the first layer of pliable material and a corresponding interior surface of the third layer of pliable material are affixed by welding, adhesive bonding and the like, along a length of the one or more seams. Alternatively, the one or more seams may be formed by stitching first and second seam boundaries for each of the one or more seams (thereby defining a width for each seam in the one or more seams), or the one or more seams may be integrally formed in a weaving or knitting process.

Once the one or more seams separating one or more baffles of a garment/pod are provided, the one or more seams may be perforated by laser cutting, die cutting, or any other suitable method, to form a plurality of perforations on and through the one or more seams. Alternatively, the plurality of perforations may be integrally formed in the knitting or weaving process, when the one or more seams are formed in the process of forming the garment panels. Any and all aspects, and any variation thereof, are contemplated as being within the scope herein.

Advantages of Providing Garments with Vent Openings:

As described above, garments constructed in accordance with aspects of the present invention may comprise vent openings that allow an environment internal to the garment to be in communication with an environment that is external to the garment by allowing a two-way airflow through the vent openings, thereby allowing a wearer of the garment to keep a comfortable level of protection throughout, for example, an entire workout. In other words, the vent openings allow the wearer to wear the insulated garment comfortably without overheating.

Therefore, the number of vent openings, the size of the vent openings, and the location of the vent openings may have an effect on the performance of the garment in keeping a balance between cooling down a wearer by allowing heat and moisture to escape through the vent openings and providing insulation in cold weather. For example, when comparing, for example, a first insulated garment comprising 0 (no) vent openings with an insulated garment comprising, for example 18 vent openings distributed throughout, the addition of vent openings may not affect the insulation properties of the garment but may have a positive effect in improving (i.e., decreasing) the evaporative resistance of the garment once vent openings are introduced to the garment because the vent openings may improve ventilation to effectively allow moisture vapor to vent out of the garment.

The aspects described throughout this specification are intended in all respects to be illustrative rather than restrictive. Upon reading the present disclosure, alternative aspects will become apparent to ordinary skilled artisans that practice in areas relevant to the described aspects without departing from the scope of this disclosure. In addition, aspects of this technology are adapted to achieve certain features and possible advantages set forth throughout this disclosure, together with other advantages which are inherent. It will be understood that certain features and subcombinations are of utility and may be employed without reference to other features and subcombinations. This is contemplated by and is within the scope of the claims.

Since many possible embodiments may be made of the technology described herein without departing from the scope thereof, it is to be understood that all matter herein set forth or shown in the accompanying drawings is to be interpreted as illustrative and not in a limiting sense.

The invention claimed is:

1. A method of making an insulated garment, the method comprising:

forming one or more voided portions in a layer of thermally insulating sheet material;

forming a garment panel by:

positioning the layer of thermally insulating sheet material between a first layer of pliable material and a second layer of pliable material;

securing the first layer of pliable material, the layer of thermally insulating sheet material, and the second layer of pliable material to one another at seams formed along non-voided portions of the layer of thermally insulating sheet material, thereby forming baffles, the one or more voided portions enclosed within the baffles;

affixing a first portion of an interior surface of the first layer of pliable material and a second portion of an interior surface of the second layer of pliable material to one another, the first layer of pliable material and the second layer of pliable material in alignment with the one or more voided portions to form an affixed portion;

forming an opening in a central area of the affixed portion such that the opening extends through the first layer of pliable material and the second layer of pliable material; and forming the insulated garment using the garment panel.

2. The method of claim 1, wherein the seams formed along the non-voided portions of the layer of thermally insulating sheet material are non-garment forming seams formed by stitching.

3. The method of claim 1, wherein one or more of the first layer of pliable material or the second layer of pliable material comprises a woven or knit fabric/textile.

4. The method of claim 1, wherein the seams are formed by at least one of stitching and bonding.

5. A method of forming an insulated garment, the method comprising:

forming an insulated garment panel by:

positioning a layer of thermally insulating sheet material comprising a plurality of voided portions between a first layer of pliable material and a second layer of pliable material; and adhesively bonding a first portion of an interior surface of the first layer of pliable material and a second portion of an interior surface of the second layer of pliable material to one another to form an affixed portion, wherein the affixed portion is in alignment with and is formed within a first edge of a first voided portion of the plurality of voided portions of the layer of thermally insulating sheet material, wherein the affixed portion is delimited by a second edge located inwardly from the first edge of the first voided portion; and forming the insulated garment using the insulated garment panel.

6. The method of claim 5, further comprising forming a non-insulated garment panel from a third layer of pliable material.

7. The method of claim 6, wherein the third layer of pliable material is the same as at least one of the first layer of pliable material or the second layer of pliable material.

8. The method of claim 6, wherein the third layer of pliable material is different from the first layer of pliable material and the second layer of pliable material.

9. The method of claim 5 further comprising forming a vent inwardly from the second edge of the affixed portion.

10. The method of claim 9, wherein the vent is delimited by a third edge, wherein the vent extends through the first layer of pliable material and the second layer of pliable material.

11. The method of claim 5 further comprising securing the first layer of pliable material, the layer of thermally insulating sheet material, and the second layer of pliable material to one another at seams formed along non-voided portions of the layer of thermally insulating sheet material, thereby forming baffles, the baffles enclosing one or more voided portions of the plurality of voided portions of the layer of thermally insulating sheet material.

12. The method of claim 11, wherein the seams are formed by stitching.

13. The method of claim 5, wherein at least one of the first layer of pliable material or the second layer of pliable material is comprised of a woven or knit fabric/textile.

* * * * *